US010968903B1

(12) United States Patent
Olson et al.

(10) Patent No.: US 10,968,903 B1
(45) Date of Patent: Apr. 6, 2021

(54) HANDHELD SANITARY FLUID SPRAYER HAVING RESILIENT POLYMER PUMP CYLINDER

(71) Applicant: Graco Minnesota Inc., Minneapolis, MN (US)

(72) Inventors: Diane L. Olson, Elk River, MN (US); Christopher C. Hines, Andover, MN (US); Robert W. Kinne, Columbia Heights, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 17/029,685

(22) Filed: Sep. 23, 2020

Related U.S. Application Data

(60) Provisional application No. 63/034,470, filed on Jun. 4, 2020.

(51) Int. Cl.

| | |
|---|---|
| ***F04B 53/16*** | (2006.01) |
| ***F04B 53/14*** | (2006.01) |
| ***F04B 7/04*** | (2006.01) |
| ***F04B 17/03*** | (2006.01) |
| ***B05B 9/08*** | (2006.01) |

(52) U.S. Cl.
CPC ..... *F04B 17/03* (2013.01); *B05B 9/0861* (2013.01); *F04B 7/04* (2013.01); *F04B 53/14* (2013.01); *F04B 53/16* (2013.01)

(58) Field of Classification Search
CPC ..... F04B 17/03; F04B 53/14; F04B 53/146; F04B 53/16; F04B 1/0408; F04B 1/24; F04B 1/146; F04B 27/0409; F04B 34/04; F04B 7/04; B05B 9/0861; B05B 9/01; B05B 12/002
See application file for complete search history.

(56) References Cited

U.S. PATENT DOCUMENTS

| | | | |
|---|---|---|---|
| 1,650,377 | A | 11/1927 | Nixon |
| 1,911,603 | A | 5/1933 | Breuer |
| 2,195,929 | A | 4/1940 | Klett |
| 2,405,006 | A | 7/1946 | Ashton |

(Continued)

FOREIGN PATENT DOCUMENTS

| | | | |
|---|---|---|---|
| CN | 2225310 | Y | 4/1996 |
| CN | 1185525 | A | 6/1998 |

(Continued)

OTHER PUBLICATIONS

Polymer-Carbide_td pdf from dudick.com/wp-content/uploads/Polymer-Carbide_td.pdf (Year: 2018).*

(Continued)

*Primary Examiner* — Devon C Kramer
*Assistant Examiner* — David N Brandt
(74) *Attorney, Agent, or Firm* — Kinney & Lange, P. A.

(57) ABSTRACT

A pump draws fluid from a reservoir and drives the fluid downstream to a spray tip where the fluid is applied to a surface. The pump includes a polymer pump body and a metallic piston configured to reciprocate relative to and within the polymer pump body. The metallic piston interfaces with an inner cylinder formed within the polymer pump body and pumps fluid through the polymer pump body to a spray nozzle downstream of the inner cylinder.

18 Claims, 10 Drawing Sheets

(56) References Cited

U.S. PATENT DOCUMENTS

| | | | |
|---|---|---|---|
| 2,407,792 | A | 9/1946 | McMillan |
| 2,488,789 | A | 11/1949 | Williams |
| 2,491,230 | A | 12/1949 | Theis |
| 2,540,357 | A | 2/1951 | Stanley |
| 2,629,539 | A | 2/1953 | Drewes, Jr. |
| 2,736,606 | A | 2/1956 | Kmiotek |
| 2,752,854 | A | 7/1956 | Prior et al. |
| 2,999,646 | A | 9/1961 | Wagner |
| 3,207,080 | A | 9/1965 | Schlosser |
| 3,250,225 | A | 5/1966 | Taplin |
| 3,276,389 | A | 10/1966 | Bower, Jr. |
| 3,317,141 | A | 5/1967 | Mann |
| 3,403,818 | A | 10/1968 | Enssle |
| 3,416,461 | A | 12/1968 | McFarland |
| 3,462,082 | A | 8/1969 | Everett |
| 3,633,828 | A | 1/1972 | Larson |
| 3,658,257 | A | 4/1972 | Rood |
| 3,680,981 | A | 8/1972 | Wagner |
| 3,741,689 | A | 6/1973 | Rupp |
| 3,769,879 | A | 11/1973 | Lofquist, Jr. |
| 3,775,030 | A | 11/1973 | Wanner |
| 3,893,627 | A | 7/1975 | Siczek et al. |
| 3,916,449 | A | 11/1975 | Davis |
| 3,955,709 | A | 5/1976 | Coley et al. |
| 3,955,763 | A | 5/1976 | Pyle et al. |
| 3,993,250 | A | 11/1976 | Shure |
| 3,999,896 | A | 12/1976 | Sebastiani |
| 4,008,984 | A | 2/1977 | Scholle |
| 4,033,511 | A | 7/1977 | Chamberlin |
| 4,068,982 | A | 1/1978 | Quarve |
| 4,160,525 | A | 7/1979 | Wagner |
| 4,162,037 | A | 7/1979 | Koyama |
| 4,165,836 | A | 8/1979 | Eull |
| 4,235,377 | A | 11/1980 | Davis et al. |
| 4,294,408 | A | 10/1981 | Snyder et al. |
| 4,301,971 | A | 11/1981 | Cornelius et al. |
| 4,365,745 | A | 12/1982 | Beck |
| 4,386,739 | A | 6/1983 | Kwok |
| 4,403,924 | A | 9/1983 | Gebauer et al. |
| 4,442,977 | A | 4/1984 | Beiswenger et al. |
| 4,484,707 | A | 11/1984 | Calder |
| 4,549,467 | A | 10/1985 | Wilden et al. |
| 4,756,481 | A | 7/1988 | Leuenberger |
| 4,778,356 | A | 10/1988 | Hicks |
| 4,800,801 | A | 1/1989 | van Zweeden |
| 4,883,412 | A | 11/1989 | Malizard et al. |
| 4,902,206 | A | 2/1990 | Nakazawa et al. |
| 4,971,249 | A | 11/1990 | Tam et al. |
| 5,051,067 | A | 9/1991 | Terauchi |
| 5,054,947 | A | 10/1991 | Frank et al. |
| 5,066,199 | A | 11/1991 | Reese et al. |
| 5,092,750 | A | 3/1992 | Leroy et al. |
| 5,100,058 | A | 3/1992 | Wei |
| 5,106,274 | A | 4/1992 | Holtzapple |
| 5,137,431 | A | 8/1992 | Kiyoshi et al. |
| 5,145,339 | A | 9/1992 | Lehrke et al. |
| 5,150,841 | A | 9/1992 | Silvenis et al. |
| 5,165,869 | A | 11/1992 | Reynolds |
| 5,174,731 | A | 12/1992 | Korver |
| 5,211,611 | A | 5/1993 | Lammers et al. |
| 5,213,485 | A | 5/1993 | Wilden |
| 5,219,274 | A | 6/1993 | Pawlowski et al. |
| 5,249,932 | A | 10/1993 | Van Bork |
| 5,271,537 | A | 12/1993 | Johnson |
| 5,340,029 | A | 8/1994 | Adams |
| 5,362,212 | A | 11/1994 | Bowen et al. |
| 5,378,122 | A | 1/1995 | Duncan |
| 5,391,058 | A | 2/1995 | Goto et al. |
| 5,443,211 | A | 8/1995 | Young et al. |
| 5,527,160 | A | 6/1996 | Kozumplik, Jr. et al. |
| 5,567,118 | A | 10/1996 | Grgurich et al. |
| 5,616,005 | A | 4/1997 | Whitehead |
| 5,649,809 | A | 7/1997 | Stapelfeldt |
| 5,699,967 | A | 12/1997 | Conatser et al. |
| 5,716,007 | A | 2/1998 | Nottingham et al. |
| 5,769,321 | A | 6/1998 | Cyphers |
| 5,816,778 | A | 10/1998 | Elsey, Jr. et al. |
| 5,839,612 | A | 11/1998 | Burke |
| 5,927,954 | A | 7/1999 | Kennedy et al. |
| 6,106,246 | A | 8/2000 | Steck et al. |
| 6,142,749 | A | 11/2000 | Jack et al. |
| 6,158,982 | A | 12/2000 | Kennedy et al. |
| 6,168,093 | B1 | 1/2001 | Greer, Jr. et al. |
| 6,264,115 | B1 | 7/2001 | Liska et al. |
| 6,280,149 | B1 | 8/2001 | Able et al. |
| 6,299,415 | B1 | 10/2001 | Bahrton |
| 6,364,622 | B1 | 4/2002 | Lishanski et al. |
| 6,390,386 | B2 | 5/2002 | Krohn et al. |
| 6,402,486 | B1 | 6/2002 | Steck et al. |
| 6,488,180 | B1 | 12/2002 | Bayat |
| 6,599,107 | B2 | 7/2003 | Cooper et al. |
| 6,644,564 | B2 | 11/2003 | Perkitny |
| 6,702,198 | B2 | 3/2004 | Tam et al. |
| 6,708,900 | B1 | 3/2004 | Zhu et al. |
| D490,500 | S | 5/2004 | Ye et al. |
| 6,752,067 | B1 | 6/2004 | Davidson et al. |
| 6,752,330 | B2 | 6/2004 | DiMaggio et al. |
| 6,811,099 | B2 | 11/2004 | Krestine et al. |
| 6,817,544 | B2 | 11/2004 | Hanson |
| 6,933,634 | B2 | 8/2005 | Frank et al. |
| 6,978,944 | B1 | 12/2005 | Carey et al. |
| 7,018,181 | B2 | 3/2006 | Cooper et al. |
| 7,025,087 | B2 | 4/2006 | Weinberger et al. |
| 7,097,119 | B2 | 8/2006 | Hornsby et al. |
| 7,182,280 | B2 | 2/2007 | Ye et al. |
| 7,207,500 | B2 | 4/2007 | Hudson et al. |
| 7,219,848 | B2 | 5/2007 | Sweeton |
| 7,244,464 | B2 | 7/2007 | Robens et al. |
| 7,255,294 | B2 | 8/2007 | Sweeton et al. |
| 7,350,723 | B2 | 4/2008 | Reedy |
| 7,354,255 | B1 | 4/2008 | Lishanski et al. |
| 7,399,168 | B1 | 7/2008 | Eberwein |
| 7,478,979 | B2 | 1/2009 | Zhou et al. |
| 7,517,199 | B2 | 4/2009 | Reed et al. |
| 7,600,985 | B2 | 10/2009 | Meloche et al. |
| 7,654,801 | B2 | 2/2010 | Spude |
| 7,658,598 | B2 | 2/2010 | Reed et al. |
| 7,708,084 | B2 | 5/2010 | Duesselberg et al. |
| 7,731,105 | B2 | 6/2010 | Lishanski et al. |
| 7,758,321 | B2 | 7/2010 | Fukano et al. |
| 8,123,500 | B2 | 2/2012 | Juterbock et al. |
| 8,167,586 | B2 | 5/2012 | Towne |
| 8,182,247 | B2 | 5/2012 | Gallwey et al. |
| 8,292,600 | B2 | 10/2012 | Reed et al. |
| 8,313,313 | B2 | 11/2012 | Juterbock et al. |
| 8,382,445 | B2 | 2/2013 | Roseberry |
| 8,393,881 | B2 | 3/2013 | Usui et al. |
| 8,485,792 | B2 | 7/2013 | McCourt et al. |
| 8,585,372 | B2 | 11/2013 | Bacher et al. |
| 8,746,597 | B2 | 6/2014 | Sides |
| 10,322,424 | B2 | 6/2019 | Wright |
| 10,589,298 | B2 | 3/2020 | Wright |
| 2001/0035515 | A1 | 11/2001 | Kennedy et al. |
| 2001/0038041 | A1 | 11/2001 | Leer et al. |
| 2001/0048882 | A1 | 12/2001 | Layman |
| 2002/0028103 | A1 | 3/2002 | Frank et al. |
| 2003/0173420 | A1 | 9/2003 | Hanson |
| 2004/0057853 | A1 | 3/2004 | Ross et al. |
| 2004/0069791 | A1 | 4/2004 | Neal |
| 2004/0155118 | A1 | 8/2004 | Rice |
| 2004/0217205 | A1 | 11/2004 | Kohs et al. |
| 2004/0226969 | A1 | 11/2004 | Shew |
| 2004/0251321 | A1 | 12/2004 | Ye et al. |
| 2004/0256490 | A1 | 12/2004 | Sweeton |
| 2005/0016448 | A1 | 1/2005 | Dilou |
| 2005/0189445 | A1 | 9/2005 | Hartle et al. |
| 2006/0040044 | A1 | 2/2006 | Robens et al. |
| 2006/0076434 | A1 | 4/2006 | Hornsby et al. |
| 2006/0086824 | A1 | 4/2006 | Pearce, III et al. |
| 2006/0108981 | A1 | 5/2006 | Watson et al. |
| 2006/0153707 | A1 | 7/2006 | Sweeton et al. |
| 2006/0208005 | A1 | 9/2006 | Sweeton |
| 2006/0257271 | A1 | 11/2006 | Juterbock et al. |
| 2007/0025863 | A1 | 2/2007 | Liedtke et al. |

(56) References Cited

U.S. PATENT DOCUMENTS

| | | | | |
|---|---|---|---|---|
| 2007/0092385 | A1 | 4/2007 | Petrie Pe | |
| 2007/0125878 | A1 | 6/2007 | Hahn et al. | |
| 2007/0129469 | A1 | 6/2007 | Befurt et al. | |
| 2007/0131109 | A1 | 6/2007 | Bruggeman et al. | |
| 2007/0134050 | A1 | 6/2007 | Bruggeman et al. | |
| 2007/0137938 | A1 | 6/2007 | Carpenter et al. | |
| 2007/0170285 | A1 | 7/2007 | Schouten | |
| 2007/0212241 | A1 | 9/2007 | Lishanski et al. | |
| 2007/0224358 | A1 | 9/2007 | Insausti-Eciolaza et al. | |
| 2007/0228186 | A1 | 10/2007 | Hornsby et al. | |
| 2007/0252019 | A1 | 11/2007 | Peterson et al. | |
| 2007/0261913 | A1 | 11/2007 | Rossner et al. | |
| 2007/0272707 | A1 | 11/2007 | Peralta et al. | |
| 2007/0278326 | A1 | 12/2007 | Wu | |
| 2007/0278787 | A1 | 12/2007 | Jones et al. | |
| 2008/0065001 | A1 | 3/2008 | DiNucci et al. | |
| 2008/0104780 | A1 | 5/2008 | Dayton et al. | |
| 2008/0173705 | A1 | 7/2008 | Girard et al. | |
| 2009/0068036 | A1 | 3/2009 | Hsu et al. | |
| 2009/0145980 | A1 | 6/2009 | Jones | |
| 2009/0152382 | A1 | 6/2009 | Charpie | |
| 2010/0045096 | A1 | 2/2010 | Schonlau et al. | |
| 2010/0072300 | A1* | 3/2010 | Miller | B05B 9/0416 239/332 |
| 2010/0196176 | A1 | 8/2010 | Kaufmann et al. | |
| 2010/0237161 | A1* | 9/2010 | Sandahi | B25F 5/02 239/4 |
| 2011/0198413 | A1 | 8/2011 | Thompson et al. | |
| 2012/0037726 | A1 | 2/2012 | Johnson et al. | |
| 2012/0063925 | A1 | 3/2012 | Parker | |
| 2012/0227389 | A1 | 9/2012 | Hinderks | |
| 2012/0243630 | A1 | 9/2012 | Golovins | |
| 2012/0298771 | A1 | 11/2012 | Johnson et al. | |
| 2013/0101445 | A1 | 4/2013 | Schutze | |
| 2015/0226205 | A1 | 8/2015 | Hines et al. | |
| 2015/0226206 | A1 | 8/2015 | Hines et al. | |
| 2015/0314312 | A1* | 11/2015 | Luczak | B05B 11/3001 239/373 |
| 2017/0291181 | A1 | 10/2017 | Wright | |
| 2018/0071761 | A1* | 3/2018 | Luczak | F04B 7/04 |
| 2019/0060922 | A1 | 2/2019 | Wright | |
| 2019/0201927 | A1 | 7/2019 | Sides | |
| 2020/0121867 | A1 | 4/2020 | Wright | |

FOREIGN PATENT DOCUMENTS

| | | | |
|---|---|---|---|
| CN | 1974282 | A | 6/2007 |
| CN | 2912820 | Y | 6/2007 |
| CN | 101022891 | A | 8/2007 |
| CN | 101049587 | A | 10/2007 |
| CN | 200998701 | Y | 1/2008 |
| CN | 201101999 | Y | 8/2008 |
| CN | 101273198 | A | 9/2008 |
| CN | 102066710 | A | 5/2011 |
| DE | 2433841 | A1 | 2/1976 |
| DE | 10315483 | A1 | 11/2004 |
| EP | 0312862 | A2 | 4/1989 |
| EP | 0714709 | A1 | 6/1996 |
| EP | 0781922 | A1 | 7/1997 |
| EP | 1479448 | A2 | 11/2004 |
| EP | 1627689 | A1 | 2/2006 |
| EP | 2168686 | A2 | 3/2010 |
| FR | 2307983 | A1 | 11/1976 |
| GB | 1576075 | | 10/1980 |
| GB | 2302254 | A | 1/1997 |
| GR | 1005628 | B | 9/2007 |
| JP | S31010693 | A | 12/1956 |
| JP | S5138325 | A | 3/1976 |
| JP | S57131866 | U | 8/1982 |
| JP | S57200678 | A | 12/1982 |
| JP | S60178368 | A | 9/1985 |
| JP | S6183474 | U | 6/1986 |
| JP | S61255280 | A | 11/1986 |
| JP | S6259989 | B2 | 12/1987 |
| JP | S63100963 | A | 5/1988 |
| JP | S6421769 | U | 2/1989 |
| JP | H01148356 | A | 6/1989 |
| JP | H02500459 | A | 2/1990 |
| JP | H02196173 | A | 8/1990 |
| JP | 4346862 | A | 12/1992 |
| JP | 194997 | A | 8/1995 |
| JP | H10290942 | A | 11/1998 |
| JP | 2001506720 | A | 5/2001 |
| JP | 2004261720 | A | 9/2004 |
| JP | 2005324089 | A | 11/2005 |
| JP | 2007222787 | A | 9/2007 |
| JP | 2007330750 | A | 12/2007 |
| JP | 2008246404 | A | 10/2008 |
| JP | 2012506316 | A | 3/2012 |
| KR | 1019970700134 | A | 1/1997 |
| KR | 102110089287 | A | 8/2011 |
| TW | 454575 | U | 9/2001 |
| WO | WO2007079932 | A1 | 7/2007 |
| WO | WO2011094246 | A1 | 8/2011 |
| WO | WO2017112781 | A1 | 6/2017 |

OTHER PUBLICATIONS

Polymer-Steel-MG_td pdf from dudick.com/wp-content/uploads/Polymer-Steel-MG_td.pdf (Year: 2016).*

Curve _ mathematics _ Britannica pdf from britannica.com/science/curve (Year: 2020).*

* cited by examiner

HANDHELD SANITARY FLUID SPRAYER HAVING RESILIENT POLYMER PUMP CYLINDER

CROSS-REFERENCE TO RELATED APPLICATION(S)

This application claims priority to U.S. Provisional Application No. 63/034,470 filed Jun. 4, 2020, and entitled "HANDHELD SANITARY FLUID SPRAYER HAVING RESILIENT POLYMER PUMP CYLINDER," the disclosure of which is hereby incorporated by reference in its entirety.

BACKGROUND

This disclosure generally relates to fluid sprayers. More particularly, this disclosure relates to handheld sanitary fluid sprayers.

Sprayers apply the fluid to a surface through a nozzle. Sanitary fluid is used for disinfection, decontaminating, sanitizing, deodorizing, and other cleaning purposes. Sanitary fluid solutions are typically of low viscosity and contain over 95% water. Sanitary fluid solutions can be corrosive and cause degradation of various metals, such as aluminums and carbon steels, among others. Sanitary fluid sprayers can include a tank that is pneumatically pressurized to drive the air through a nozzle by way of the air pressure.

SUMMARY

According to an aspect of the disclosure, a pump for a sanitary fluid sprayer includes a polymer pump body defining an inner cylinder and a first metallic piston configured to reciprocate within the inner cylinder.

According to an additional or alternative aspect of the disclosure, a pump for a handheld sanitary fluid sprayer includes a polymer pump body comprising a polymer material that defines an inner surface of an inner cylinder that forms a pumping chamber within the polymer pump body; a driver including an electric motor; a first metallic piston including an outer surface, a piston face, and a tapered interface between the outer surface and the face; and a nozzle to spray the spray fluid pumped by reciprocation of the piston within the pumping chamber. The first metallic piston is configured to reciprocate within the pumping chamber such that the outer surface of the piston comes into and out of contact with the inner surface of the inner cylinder to pump spray fluid, the piston reciprocated by the driver. An outer diameter of the first metallic piston at the outer surface is larger than an inner diameter of the inner cylinder at the inner surface when the outer surface is out of contact with the inner surface of the inner cylinder.

According to an additional or alternative aspect of the disclosure, a handheld sanitary fluid sprayer includes a housing, a handle configured to support the housing, a reservoir connected to the housing and configured to hold sanitary fluid, a nozzle configured to emit a spray of sanitary fluid, a trigger configured to control spraying from the nozzle, a driver including an electric motor, and a pump supported by the housing and configured to pump sanitary fluid from the reservoir to the nozzle. The pump includes a polymer pump body including an inlet bore and a first inner cylinder, the inlet bore configured to provide the sanitary fluid to the first inner cylinder; and a first metallic piston configured to linearly reciprocate within the first inner cylinder to pump the sanitary fluid to the nozzle under pressure. The first metallic piston is configured to be reciprocated by the driver within the first inner cylinder so that a metal-to-polymer interface dynamically seals during reciprocation to pump sanitary fluid.

According to another additional or alternative aspect of the disclosure, a sanitary spray system includes a nozzle configured to emit a spray of sanitary fluid and a pump configured to pump sanitary fluid to the nozzle under pressure to generate the spray of sanitary fluid. The pump includes a polymer pump body and a first metallic piston. The polymer pump body includes a fluid intake and a first inner cylinder. The fluid intake is configured to provide the sanitary fluid to the first inner cylinder. The first metallic piston is configured to linearly reciprocate within the first inner cylinder to pump the sanitary fluid to the nozzle under pressure. An interference fit is formed between the first metallic piston and the first inner cylinder during reciprocation of the first metallic piston within the first inner cylinder.

DETAILED DESCRIPTION

Handheld sprayers according to the present disclosure spray sanitary fluids onto surfaces. The handheld fluid sprayers can be used to spray fluids for disinfecting, decontaminating, sanitizing, deodorizing, and other sanitation purposes. Typical sanitary fluid solutions contain chemical, solvent, or other components that are highly corrosive. The fluid solutions are typically of low viscosity and are readily atomized for spraying. The spray fluids are typically formed of 95% or more water.

Figure 1A:
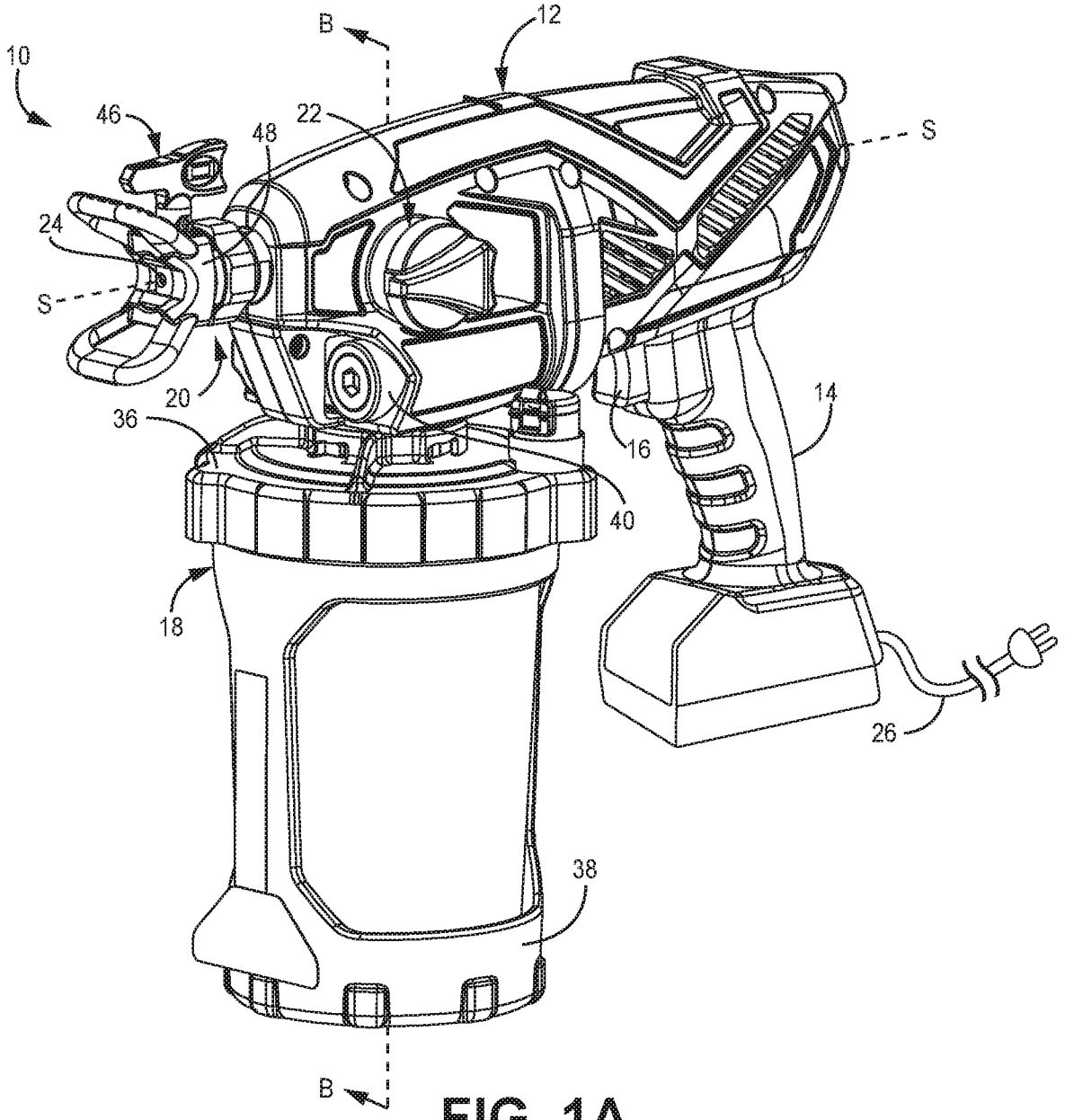
FIG. 1A is an isometric view of a handheld fluid sprayer.
Figure 1B:
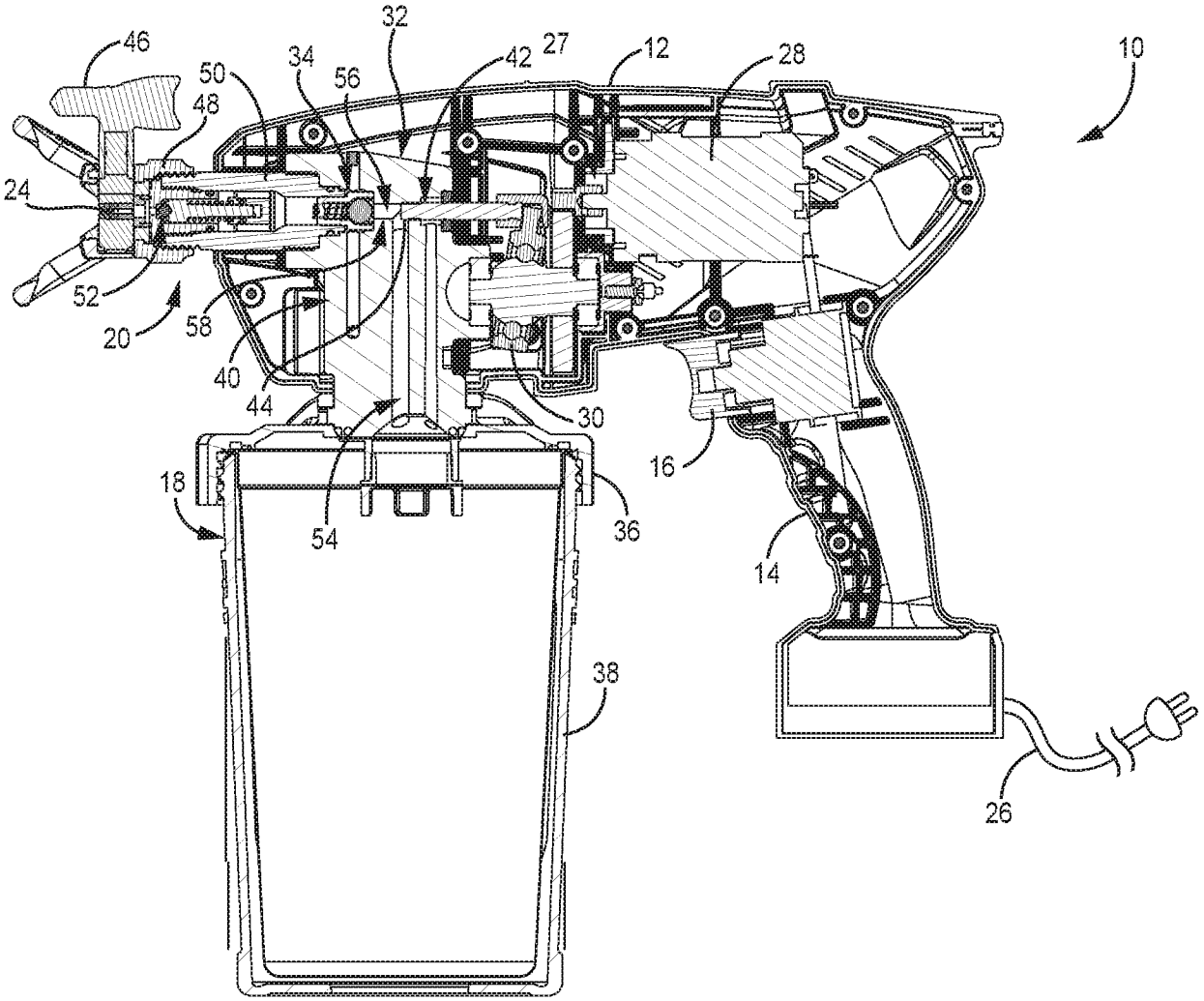
FIG. 1B is a cross-sectional view of a handheld fluid sprayer taken along line B-B in FIG. 1A.

FIG. 1A is a perspective view of sprayer 10. FIG. 1B is a cross-sectional view of sprayer 10 taken along line B-B in FIG. 1A. FIGS. 1A and 1B will be discussed together. Sprayer 10 includes housing 12, handle 14, trigger 16, reservoir 18, tip assembly 20, prime valve 22, nozzle 24, power source 26, driver 27, motor 28, drive 30, pump 32, outlet check valve 34, and spray tip 46. Reservoir 18 includes lid 36 and reservoir body 38. Pump 32 includes pump body 40 and piston 42. Tip assembly 20 includes tip holder 48, tube 50, and spray valve 52.

Housing 12 supports other components of sprayer 10. Housing 12 can be formed of any suitable material for supporting other components of sprayer 10. For example, housing 12 can be formed from a polymer or metal. In the example shown, housing 12 is a clamshell housing formed from two halves with a seam along a lateral center of housing 12. Handle 14 projects from a lower side of housing 12. A user can hold, support the full weight of, and operate sprayer 10 by grasping handle 14. Handle 14 extends relative housing 12 and can, in some examples, be formed by housing 12. The user can manipulate the position of sprayer 10 to apply the spray to a variety of surfaces and from a variety of angles.

Trigger 16 projects from housing 12 and is movable relative housing 12. In some examples, trigger 16 projects from handle 14. Trigger 16 can be actuated to control spraying by sprayer 10. For example, the user can grasp trigger 16 with fingers of the hand holding handle 14 and can pull trigger 16 rearwards towards handle 14 to initiate spraying by sprayer 10. Trigger 16 can then be released to stop spraying by sprayer 10.

Reservoir 18 is mounted to sprayer 10 and configured to store a supply of sanitary fluid for spraying. In some examples, reservoir 18 can include a flexible polymer container, such as a bag, within reservoir body 38 and within which the sanitary spray fluid is stored. Lid 36 connects to reservoir body 38 and can enclose the interior of reservoir 18. Lid 36 can secure the flexible container within reservoir 18 by capturing a portion of the container between lid 36 and reservoir body 38. In the example shown, reservoir 18 includes windows through which the user can grasp and squeeze the flexible polymer container to eliminate air and prime the pump 32. In some examples, reservoir body 38 can itself hold the fluid. In the example shown, the user can detach reservoir 18 from pump body 40 by rotating reservoir 18 relative pump body 40. Reservoir 18 can be filled with spray material and spraying resumed by reattaching reservoir 18 and actuating trigger 16. While reservoir 18 is shown as mounted to housing 12, it is understood that reservoir 18 can be remote from housing 12 and can provide fluid through a fluid line. For example, reservoir 18 can be a backpack connected to sprayer 10 by tubing, a separate reservoir held in a hand of the user, or a bucket storing the sanitary fluid, among other options.

In the example shown, reservoir 18 and handle 14 each project from the same side of housing 12 (e.g., both handle 14 and reservoir 18 are disposed below a spray axis S-S through nozzle 24). It is understood that, in some examples, handle 14 and reservoir 18 can be disposed on different sides of housing 12. In some examples, handle 14 and reservoir 18 can be disposed on opposite sides of housing 12 (e.g., one of handle 14 and reservoir 18 can extend from a top side of housing 12 and the other can extend from a bottom side of housing 12). Handle 14 and reservoir 18 can be disposed on opposite sides of a horizontal plane through the spray axis S-S.

Driver 27 includes motor 28 and drive 30 and is configured to power reciprocation of piston 42. Motor 28 is disposed within and supported by housing 12. Motor 28 can be electrically powered. Motor 28 is configured to power reciprocation of piston 42. For example, motor 28 can be an electric rotary motor (e.g., a brushless DC, or AC induction, motor). In the example shown, the motor 28 outputs rotational motion to drive 30. The drive 30 converts rotational motion output from the motor 28 to linear reciprocating motion that drives the pump 32. In the particular embodiment, the drive 30 is a wobble-type drive, though it is understood that drive 30 can be of any configuration suitable for converting the rotational output of motor 28 into a linear reciprocating input to piston 42, such as a scotch-yoke, eccentric, crank, among other options for converting rotating motion to reciprocating motion. It is understood that motor 28 can be a solenoid that outputs reciprocating motion. In this case, drive 30 would not be necessary such that driver 27 can include motor 28 without drive 30. Coil windings surrounding a piece formed from ferromagnetic material could be energized to repel or attract the ferromagnetic material to linearly move the piece formed from ferromagnetic material. The piece formed from ferromagnetic material can be attached to the fluid displacement member 42.

Power source 26 provides power to sprayer 10 to cause spraying by sprayer 10. Power source 26 can be a power cord that can be plugged into a suitable outlet, such as a wall socket. Additionally or alternatively, sprayer 10 can include a battery mounted to sprayer 10 for providing electric power to sprayer 10. For example, the battery can be mounted to a bottom of handle 14, among other mounting options. Power source 26 is configured to power motor 28.

Sprayer 10 can be an airless sprayer which means that sprayer 10 does not utilize air flow to propel the sanitary spray fluid. Instead, the pressures generated by pump 32 cause the atomization and spraying. It is understood that, in some examples, sprayer 10 can include air to atomize, shape, and/or guide the sanitary spray fluid. In some examples, motor 28 can drive rotation of a turbine to generate a flow of air to atomize the fluid for spraying through nozzle 24. While sprayer 10 is discussed in connection with spraying sanitary fluid, it is understood that sprayer 10.

Prime valve 22 is supported by pump 32. Prime valve 22 is placed in a prime position to prime pump 32 before initiating spraying. Prime valve 22 is actuated to a spray position during spraying. Prime valve 22 circulates fluid to reservoir 18 when in the prime position and closes that flowpath so the fluid instead flows out nozzle 24 when in the spray position.

Pump 32 is partially or fully contained within a pump body 40 which itself is part of the pump 32. Pump body 40 is supported by housing 12. The pump body 40 can be a block of polymer that encases one or more parts of the pump 32 and also structurally supports the pump 32. The pump body 40 can be formed from a single piece of injected polymer material. The polymer material can be nylon, such as glass filled nylon (polyamide). The polymer may alternatively be acetal homopolymer.

The pump body 40 defines multiple fluid pathways. The fluid pathways can be formed during the injection molding process of the pump body 40 and/or can be machined from the polymer block after molding. One fluid pathway is the fluid intake 54. The fluid intake 54 provides a pathway for spray material to be drawn from the reservoir 18 up to a pump chamber 56 that is at least partially defined by inner cylinder 58.

Piston 42 drives spray fluid through nozzle 24 under pressure to generate the fluid spray. Piston 42 reciprocates within pump body 40. The exterior of piston 42 can directly contact portions of the pump body 40 defining the pump chamber 56 during reciprocation of piston 42. Relative movement between the interfacing surfaces of piston 42 and pump body 40 form dynamic seals that facilitate generation of sufficient spray pressure to atomize the sanitary fluid into a desirable spray pattern.

A contoured or tapered interface is formed at the distal end of piston 42 and extends between the exterior surface of piston and the face of piston 42. The tapered interface reduces the diameter of piston 42 to prevent gouging or other damage to polymer pump body 40. The contoured interface can be curved. In the example shown, the interface includes annular shoulder 44, which is a contoured surface that provides a smooth transition at the distal end of piston 42. Annular shoulder 44 eliminates sharp corners on piston 42 to prevent contact damage from occurring between piston 42 and pump body 40. Annular shoulder 44 is the first part of piston 42 to contact the portion of pump body defining inner cylinder 58 as piston 42 moves through the pressure stroke. Annular shoulder 44 is rounded and does not have a finer right angle corner to prevent shaving and/or gouging of the polymer material the piston 42. In some examples, annular shoulder 44 can be tapered to narrow in the downstream direction, from the exterior surface of piston 42 towards the distal downstream face, to avoid gouging the inner cylinder 58. Even so, only the interface at the corner of piston 42 (e.g., annular shoulder 44) is rounded and the center area (e.g., the exterior surface) of piston 42 is flat.

Piston 42 is elongate along reciprocation axis A-A. Piston 42 is capable of withstanding the forces experienced during pumping and reciprocation. Piston 42 can be formed from metal, such as stainless steel or titanium, or composite, among other corrosion-resistant material options. Pump body 40 is formed of polymer and supports piston 42 during reciprocation. The polymer pump body 40 and piston 42 are corrosion-resistant, which facilitates the pumping and spraying of sanitary fluids. The polymer pump body 40 forms the cylinder walls of pump chamber 56 and supports the formation of the spray pressures within pump chamber 56 that are required to generate the fluid spray through nozzle 24.

Outlet check valve 34 is disposed in and supported by pump housing 12. Outlet check valve 34 supports pumping by closing to prevent disinfectant fluid already expelled from the pump chamber 56 from flowing back into the pump chamber 56 during the suction stroke. The outlet check valve 34 opens during the pressure stroke due to pressure generated by relative movement of piston 42 to permit pumped fluid to flow from pump chamber 56 out through nozzle 24. Outlet check valve 34 can be of any desired configuration suitable for facilitating one-way flow downstream from pump chamber 56.

Tip assembly 20 is supported by pump body 40. For example, tip assembly 20 can be mounted to pump body 40. Tube 50 interfaces with pump body 40 to connect tip assembly 20 to pump body 40. For example, tube 50 and pump body 40 can be joined by interfaced threading formed on tube 50 and pump body 40, among other options. Tube 50 can interface with outlet check valve 34 to retain outlet check valve 34 in pump body 40. Spray valve 52 is supported by tip assembly 20. Spray valve 52 contains a spring-biased needle that opens to release a spray of sanitary fluid from the nozzle 24 when the pressure of the sanitary fluid developed by pump 32 reaches a threshold amount, overcoming the force exerted by the spring. It is understood that other spray valve 52 designs and methods of operation are possible.

Spray tip 46 is mounted to sprayer 10. In the example shown, spray tip 46 is supported by tip assembly 20. Nozzle 24 is formed as a part of spray tip 46 and is configured to generate the spray. Spray tip 46 is removable and can be replaced. Spray tip 46 is disposed within a bore formed in tip holder 48 that is mounted to tube 50. Spray tip 46 can be rotated between a spray position and a de-clog position. Nozzle 24 is typically the narrowest portion of the fluid path through sprayer 10 and is thus the likeliest location for clogs to form. The spray tip 46 is positioned to generate and eject an atomized fluid spray through nozzle 24 when in the spray position. Spray tip 46 is reversed to eject any clogs or clumped fluid from spray tip 46 when in the de-clog position. For example, the spray tip 46 can be rotated 180-degrees between the spray position and the de-clog position. In the spray position, the outlet of nozzle 24 is oriented out of sprayer 10. In the de-clog position, the inlet of nozzle 24 is oriented out of sprayer 10. Nozzle 24 can be configured to generate any desired spray pattern when in the spray position, such as a fan or cone, among other options. Spray tip 46 can be replaced with a spray tip 46 having a different nozzle 24 configuration to change the spray pattern.

Pump 32 generates the sanitary fluid spray by driving the sanitary fluid through nozzle 24 under pressure. In some examples, sprayer 10 includes a pressure control switch that allows the user to set an operating pressure of pump 32. For example, the control switch can be a dial that indicates the actual pressure of each setting or a range between a minimum and maximum, among other options. In some examples, a maximum spray pressure of sanitary fluid sprayer 10 can be set in the control such that the controller will not operate the motor 28 to drive the output fluid pressure above the maximum pressure. For example, the maximum pressure can be set at about 6.89 megapascal (MPa) (about 1000 pounds per square inch (psi)) or set below 6.89 MPa (1000 psi). In such examples, the user can set the output pressure in a range up to the maximum pressure at 6.89 MPa (1000 psi), but not above the maximum pressure. In some embodiments, the maximum pressure may be equal to or less than 6.89 MPa (1000 psi), equal to or less than 5.52 MPa (800 psi), equal to or less than 4.14 MPa (600 psi), equal to or less than 2.76 MPa (400 psi), or equal to or less than 1.38 MPa (200 psi). In some cases, the maximum pressure may be equal to or greater than 6.89 MPa (1000 psi), such as up to about 10.34 MPa (1500 psi).

During operation, the user can grasp handle 14 to maneuver and orient sprayer 10 to apply sprays of sanitary fluid on surfaces. The user actuates trigger 16 to cause power source 26 to power motor 28. Motor 28 proves a rotational output to drive 30 and drive 30 causes reciprocation of piston 42. Piston 42 moves forward through inner cylinder 58 to decrease the volume and increase the pressure of pump chamber 56 and thereby drive sanitary spray fluid through outlet check valve 34 to nozzle 24. Piston 42 moves rearward through inner cylinder 58 to increase the volume of pump chamber 56 and cause negative pressure to form in pump chamber 56. The negative pressure draws spray fluid into pump chamber 56 from reservoir 18. The reciprocation of piston 42 draws spray fluid into pump chamber 56 from reservoir 18 and drives the spray fluid downstream from pump chamber 56 through outlet check valve 34, spray valve 52, and nozzle 24. An outer diameter of the metallic piston 42 at the outer surface of the piston 42 can be larger than an inner diameter of the portion of the pump body 40 defining the pumping chamber 56 (e.g., inner cylinder 58) when the outer surface of the piston 42 is out of annular contact with the portion of the pump body 40 defining the pumping chamber 56.

Sprayer 10 provides significant advantages. The polymer pump body 40 interfacing with the metallic piston 42 generates pumping pressures to form the sanitary fluid spray. The interface eliminates additional components that can be corroded by sanitary fluid, such as aluminum and carbon steels. The direct interface between piston 42 and pump body 40 forms a tight dynamic seal to generate the spray pressure. The metal-to-polymer interface dynamically seals during reciprocation to pump the spray fluid. The direct interface also eliminates costly components, reducing the manufacturing cost of pump 32 and sprayer 10. Pump 32 generates the spray pressures such that the user is not required to stop spraying and recharge the sprayer to maintain the spray pressure. Instead, the user can simply depress trigger 16 to cause handheld sprayer 10 to generate the spray at the desired pressure and can continue to spray until reservoir 18 is depleted. Reservoir 18 can be detached, refilled, and reattached, and spraying can then be resumed. Handheld sprayer 10 simplifies and improves the efficiency of the sanitary spraying process.

Figure 2A:
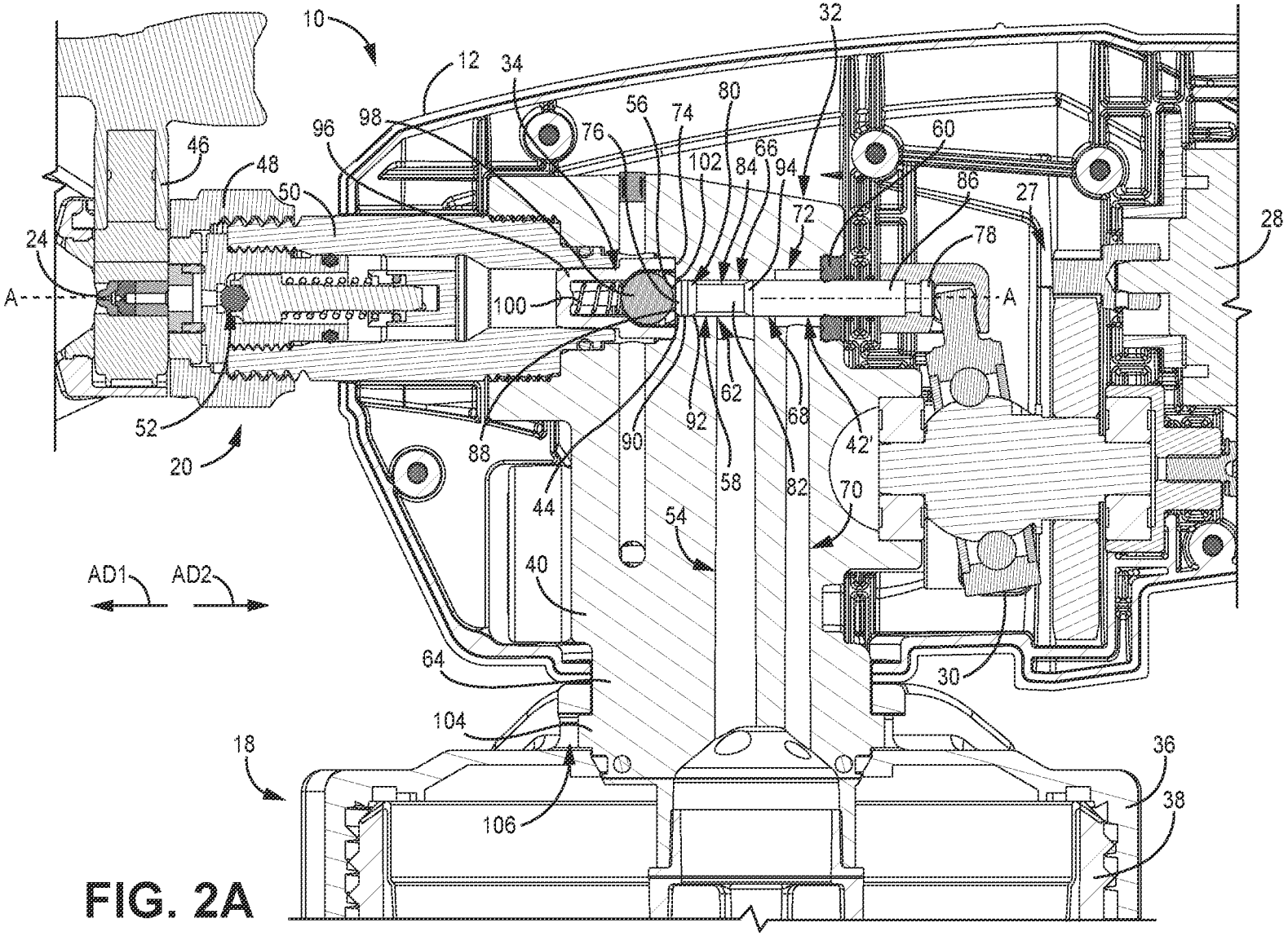
FIG. 2A is an enlarged cross-sectional view showing a pump at the end of a pressure stroke.
Figure 2B:
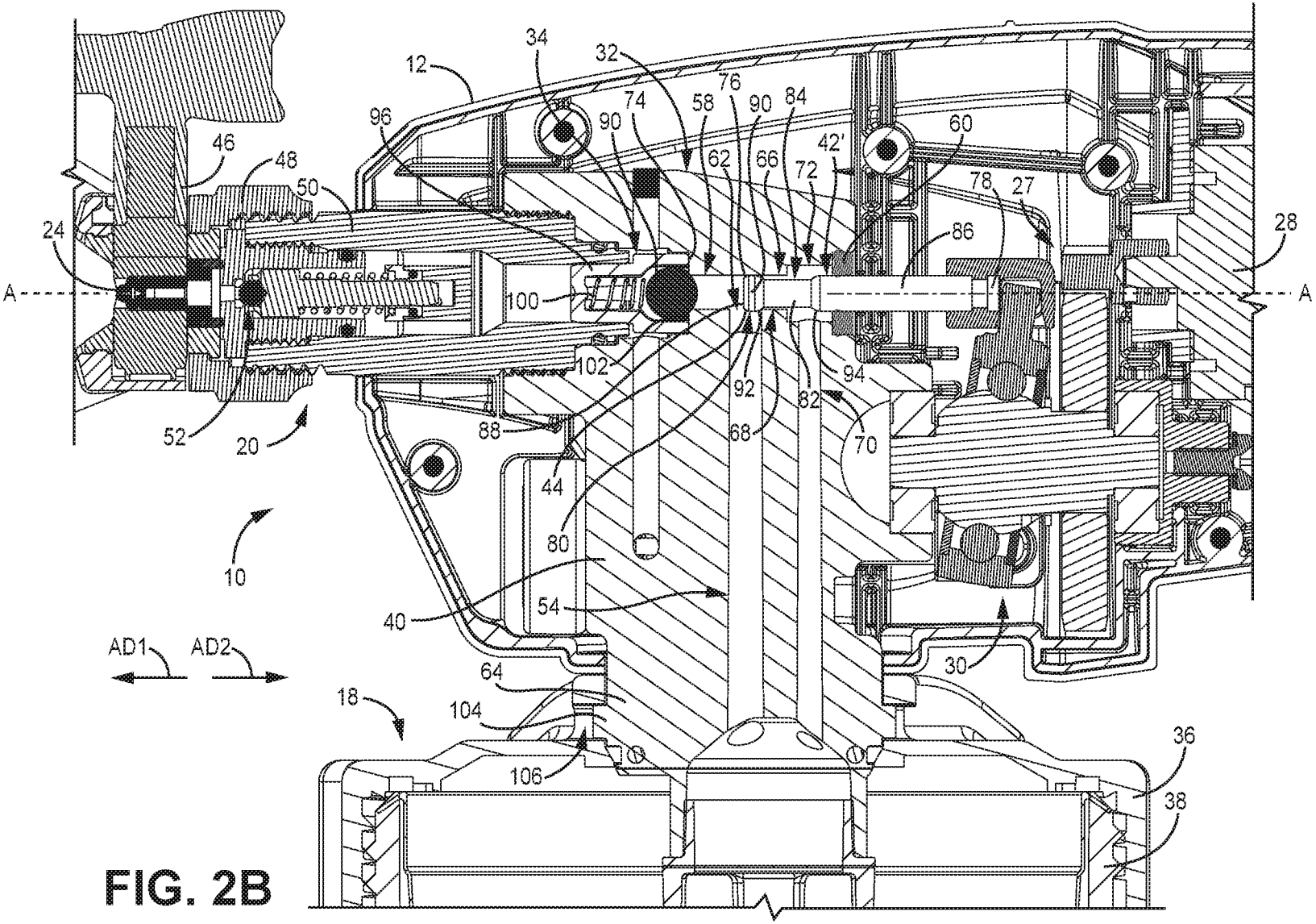
FIG. 2B is an enlarged cross-sectional view similar to FIG. 2A but showing the pump at the end of a suction stroke.

FIG. 2A is an enlarged cross-sectional view showing piston 42' at the end of a pressure stroke. FIG. 2B is a cross-sectional view similar to FIG. 2A but showing the piston 42' at the end of a suction stroke. FIGS. 2A and 2B will be discussed together. Housing 12, reservoir 18, tip assembly 20, nozzle 24, motor 28, drive 30, pump 32, outlet check valve 34, and throat seal 60 of sprayer 10 are shown. Reservoir 18 includes lid 36 and reservoir body 38. Pump 32 includes pump body 40 and piston 42'. Pump body 40 includes fluid intake 54, inner cylinder 58, pump intersection 62, neck 64, pump bore 66, upstream cylinder 68, return bore 70, rear chamber 72, and stop 74. Piston 42' includes first end 76 and second end 78. Piston 42' further includes first annular shoulder 44, head 80, piston neck 82, groove 84, piston body 86, piston face 88, outer surface 90, second annular shoulder 92, and third annular shoulder 94. Tip assembly 20 includes spray tip 46, tip holder 48, tube 50, and spray valve 52. Outlet check valve 34 includes cage 96, valve member 98, spring 100, and seat 102.

Pump 32 is at least partially disposed within housing 12 and is configured to draw spray fluid, such as sanitary fluid, among other options, from reservoir 18 and drive the spray fluid through nozzle 24 for spraying. Pump 32 includes piston 42' configured to put the spray fluid under pressure (e.g., up to about 10.34 MPa (about 1500 psi)) to generate the atomized fluid spray. It is understood that, while pump 32 has been discussed in connection spraying a sanitary fluid, any pump referenced herein can spray fluid, not just sanitary fluid.

Pump body 40 supports other components of pump 32. Pump body 40 is at least partially disposed in sprayer housing 12. In the example shown, pump body 40 extends out a lower side of housing 12. Neck 64 extends through a lower side of housing 12. Reservoir 18 can directly interface with neck 64 to mount reservoir 18 to sprayer 10. For example, slots formed in one of lid 36 and neck 64 can interface with projections formed in the other one of lid 36 and neck 64. In the example shown, projections 104 extend from neck 64 and slots 106 are formed in lid 36. Neck 64 can thereby be considered to form a mounting portion of pump body 40 for reservoir 18 to mount at.

Fluid intake 54 extends into pump body 40 and is at least partially formed through neck 64. Fluid intake 54 is configured to receive sanitary spray fluid from reservoir 18. Pump bore 66 is formed in pump body 40. Pump bore 66 can include multiple coaxial bores of differing diameters. Fluid intake 54 extends to and intersects with pump bore 66 at pump intersection 62. Pump intersection 62 is a portion of pump bore 66 where piston 42' cannot form a full annular seal. Inner cylinder 58 is formed as a part of pump bore 66. Inner cylinder 58 extends from a downstream side of pump intersection 62. Pump chamber 56 is disposed on a downstream side of the intersection between fluid intake 54 and pump bore 66 and is at least partially defined by the portion of polymer pump body 40 forming inner cylinder 58. Pump chamber 56 is further defined between piston face 88 of piston 42' and outlet check valve 34. The volume of pump chamber 56 varies between a minimum volume at an end of the pressure stroke (FIG. 2A) and a maximum volume when piston 42' passes over pump intersection 62 and opens a flowpath into pump chamber 56 (FIG. 2B).

Upstream cylinder 68 is disposed on an opposite axial side of pump intersection 62 from inner cylinder 58. Upstream cylinder 68 is disposed axially between fluid intake 54 and rear chamber 72. Rear chamber 72 is formed between upstream cylinder 68 and throat seal 60. Return bore 70 is formed through pump body 40 and defined by pump body 40. Return bore 70 is configured to provide a return flow of sanitary spray fluid to reservoir 18 from rear chamber 72. In some examples, pump bore 66 is formed such that inner cylinder 58 and upstream cylinder 68 have the same diameter.

Throat seal 60 is supported by pump body 40. Throat seal 60 is disposed annularly around piston 42'. Throat seal 60 is disposed within pump bore 66 and at an opposite end of pump bore 66 from outlet check valve 34 and pump chamber 56. Piston 42' extends through throat seal 60. Piston body 86 interfaces with throat seal 60. Throat seal 60 can be formed from rubber or other flexible material that dynamically seals with piston 42' as piston 42' reciprocates. Throat seal 60 seals pump bore 66 to prevent any fluid from leaking out of pump bore 66 and thus out of pump body 40, specifically out of rear chamber 72. In some examples, throat seal 60 can be the only dynamic seal within pump 32 not formed by a direct interface between piston 42' and pump body 40. In some examples, all dynamic interfaces that pressurize fluid during pumping are formed directly between piston 42' and pump body 40. The dynamic pressurizing interface shown is formed between piston head 80 and inner cylinder 58.

Piston 42' reciprocates within pump body 40 to vary a size of pump chamber 56 and pump the sanitary fluid. Pump chamber 56 is a fluid pathway defined by the polymer material of the pump body 40 and piston 42'. In particular, the polymer material of pump body 40 forms inner cylinder 58. The piston 42' reciprocates within the inner cylinder 58 that is formed by pump body 40. The piston 42' is linearly reciprocated by the drive 30 through its suction stroke (second axial direction AD2) and pressure stroke (first axial direction AD1). Piston 42' is cylindrical. The piston 42' is formed from metal. For example, the piston 42' can be formed from stainless steel or titanium, among other options.

Piston 42' extends from drive 30 to reciprocate within pump bore 66. Piston 42' can be cantilevered from drive 30. Piston head 80 is disposed at first end 76 and reciprocates within pump bore 66. Piston head 80 forms the distal portion of piston 42'. Piston face 88 is formed on piston head 80. Outer surface 90 is an annular surface of piston head 80 configured to oppose and slide relative to inner cylinder 58. Outer surface 90 seals tightly with the portion of pump body 40 forming inner cylinder 58 such that sanitary spray fluid does not migrate around piston head 80 during pumping. Outer surface 90 forms the portion of piston 42' interfacing with inner cylinder 58 to form an annular seal and pressurize the sanitary spray fluid. Outer surface 90 is sized to seal with inner cylinder 58 to generate sufficient spray pressure and to minimize heat generated due to friction between outer surface 90 and inner cylinder 58. The axial length of outer surface 90 is shorter than the axial length of inner cylinder 58. The axial length of outer surface 90 is shorter than the axial length of groove 84. The axial length of outer surface 90 is shorter than the axial length of piston head 80.

Piston head 80 is rounded to provide a smooth transition between outer surface 90 and piston face 88. The smooth transition prevents gouging of pump body 40 by piston 42' during the pressure stroke. First annular shoulder 44 is formed on piston 42' between piston face 88 and outer surface 90 and is rounded to prevent shaving and/or gouging of the polymer material by the piston head 80 of piston 42'. In some examples, first annular shoulder 44 can be tapered to narrow in the downstream direction, from outer surface 90 towards piston face 88, to avoid gouging the inner cylinder 58. Even so, only the corner of piston head 80 (e.g., first annular shoulder 44) is rounded and the center area (e.g., outer surface 90) of piston head 80 is flat.

Piston neck 82 is disposed axially between piston head 80 and piston body 86. Piston neck 82 has a smaller diameter than outer surface 90 and other parts of piston 42'. In some examples, piston neck 82 forms a smallest diameter portion of piston 42'. Groove 84 is disposed around piston neck 82. Groove 84 extends between piston head 80 and piston body 86.

A second rounded portion can be formed on piston head 80 to provide a smooth transition between outer surface 90 and piston neck 82. The smooth transition prevents gouging of pump body 40 by piston 42' during the suction stroke. More specifically, the second annular shoulder 92 is rounded and does not have a finer right angle corner to prevent shaving and/or gouging of the polymer material by the piston head 80 of piston 42'. In some examples, second annular shoulder 92 can be tapered to narrow in the upstream direction, from outer surface 90 towards piston neck 82, to avoid gouging the pump body 40. Even so, only the corner of piston head 80 (e.g., second annular shoulder 92) is rounded and the center area (e.g., outer surface 90) of piston head 80 is flat.

A third rounded portion can be formed on piston 42' to provide a smooth transition between piston neck 82 and piston body 86. The smooth transition prevents gouging of pump body 40 by piston 42' during the pressure stroke. More specifically, the third annular shoulder 94 is rounded and does not have a finer right angle corner to prevent shaving and/or gouging of the polymer material by the piston 42'. Third annular shoulder 94 is disposed at an opposite axial end of piston neck 82 form second annular shoulder 92.

Piston body 86 extends between piston neck 82 and second end 78. Piston body 86 extends through and seals with throat seal 60. Piston body 86 is disposed within upstream cylinder 68 during at least a portion of the pump cycle. Piston body 86 can interface with the portion of the pump body 40 forming upstream cylinder 68 to seal the flowpath through upstream cylinder 68 to rear chamber 72. Second end 78 is disposed outside of pump body 40 and connected to drive 30 to connect piston 42' to drive 30 and be reciprocated by drive 30.

Outlet check valve 34 is disposed within pump body 40 downstream of pump chamber 56. Cage 96 is disposed within a portion of pump bore 66. Cage 96 interfaces with stop 74 formed by the polymer pump body 40. Stop 74 prevents further movement of cage 96 into pump bore 66 in axial direction AD2. Valve member 98 is retained within pump body 40 by cage 96. Valve member 98 can be a ball, among other options. Valve member 98 seals with the seat 102 with an annular interface therebetween. The seat 102 is formed from the polymer material of the pump body 40. In particular, the pump chamber 56 has a circular outlet lip with which the valve member 98 interfaces and seals with on the suction stroke. But the valve member 98 lifts off of the seat 102 during the pressure stroke. As shown, spring 100 is disposed within cage 96 to bias valve member 98 towards seat 102 and assist in seating the valve member 98 during the suction stroke. It is understood that some examples of outlet check valve 34 do not include a biasing member, such as spring 100.

Tip assembly 20 is supported by pump body 40. Pump body 40 can directly support tip assembly 20 such that sprayer 10 does not include flexible tubing between pump 32 and nozzle 24. Tip assembly 20 can be disposed at least partially within housing 12 and at least partially outside of housing 12. In the example shown, tube 50 interfaces with pump body 40 such that tip assembly 20 is fully supported by pump body 40. Spray valve 52 is disposed downstream of pump 32 and pump chamber 56.

During operation, motor 28 powers reciprocation of piston 42' to cause pumping by pump 32. Piston 42' is driven through pump cycles in a reciprocating manner, which include respective suction and pressure strokes. Beginning from the position shown in FIG. 2B, piston 42' is driven in first axial direction AD1 through a pressure stroke. Piston head 80 passes over pump 62 intersection between fluid intake 54 and pump bore 66. First annular shoulder 44 is the first portion of piston 42' to contact the transitional edge formed between fluid intake 54 and pump bore 66. The contouring of first annular shoulder 44 smoothly interfaces with the polymer pump body 40. The interface can cause the polymer material defining inner cylinder 58 to elastically expand due to the movement of piston 42' within pump body 40, specifically along inner cylinder 58. For example, forward movement of piston 42' causes the inner diameter of inner cylinder 58 along pump chamber 56 to expand from contact with the piston 42'. The inner cylinder 58 then relaxes and shrinks slightly after the outer surface 90 of the piston 42' has passed over that portion of the inner cylinder 58. The same interference fit occurs as the piston 42' is pulled in the second axial direction AD2 during the suction stroke. As such, the metallic piston 42' reciprocates within bore 66 such that the outer surface of the piston 42' comes into and out of contact with inner cylinder 58, which is the portion of pump body 40 defining the pumping chamber, to pump spray fluid.

The cylindrical exterior of the piston 42' directly contacts the cylindrical interior of the inner cylinder 58. In the example shown, outer surface 90 of piston head 80 directly contacts the interior of inner cylinder 58. The surfaces slide relative to each other during the pumping and suction strokes as the interface between the surfaces seals to prevent sanitary fluid from leaking out backward past piston head 80. To increase the interference and to prevent leaking out of pump chamber 56, the outer diameter of the piston head 80 can be sized to be equal to or greater than the inner diameter of inner cylinder 58 (when the piston 42' is not directly within the pump chamber 56). As such, the inner cylinder 58 can be forced to seal with piston head 80 due to direct contact between piston 42' and pump body 40. In some examples, portions of pump body 40 can expand and contract due to engagement with and then disengagement from the piston 42'. Such elastic interaction forms a flexible but tight seal about piston 42' to prevent leaking of sanitary fluid. The cylindrical exterior of piston 42' annularly interfaces with the cylindrical interior of inner cylinder 58 during a first portion of the pump stroke of the piston 42', when the piston 42' has passed over the pump intersection 62 between fluid intake 54 and pump bore 66 and into the inner cylinder 58. The cylindrical exterior of piston 42' is out of annular contact with the inner cylinder 58 during a second portion of the pump stroke, when piston 42' is disposed outside of inner cylinder 58 (e.g., as shown in FIG. 2B).

Piston neck 82 and groove 84 pass into inner cylinder 58 after piston head 80. Groove 84 carries a portion of spray fluid into inner cylinder 58. That spray fluid contacts the interior surface of the inner cylinder 58 and provides cooling to inner cylinder 58. The spray fluid contacts and cools the inner cylinder 58 after outer surface 90 passes by that portion of inner cylinder 58. The cooling counteracts frictional heat generated during reciprocation of piston 42'.

The cylindrical exterior of piston 42' also contacts the portion of pump body forming upstream cylinder 68. Third annular shoulder 94 interfaces with pump body 40 as piston body 86 passes into upstream cylinder 68. Third annular shoulder 94 is the first portion of piston 42' to interface with the pump body 40 at upstream cylinder 68. Third annular shoulder 94 is configured to smoothly interface with and cause the polymer material defining the upstream cylinder 68 to elastically expand due to the movement of the piston 42' within the upstream cylinder 68. Piston body 86 can directly interface with the portion of pump body 40 forming upstream cylinder 68. The exterior of piston body 86 can form an interference fit with pump body 40 within upstream cylinder 68. The interface between piston 42' and pump body 40 within upstream cylinder 68 forms a fluid-tight seal to prevent fluid migration from fluid intake 54 to rear chamber 72.

In some examples, piston 42' can have multiple contact points with pump bore 66 such that piston 42' causes multiple separate portions of pump body 40 to simultaneously elastically expand during reciprocation (e.g., during a pressure stroke when first annular shoulder 44 is within inner cylinder 58 and third annular shoulder 94 is within upstream cylinder 68). The interface between piston 42' and pump body 40 axially aligns piston 42' relative pump bore 66 and supports piston 42' within pump body 40. For example, piston body 86 directly interfacing with upstream cylinder 68 assists in aligning piston 42' on axis A-A.

First annular shoulder 44 forms an annular seal with inner cylinder 58 to facilitate pressurizing pump chamber 56. Pump chamber 56 is sealed and the pressure begins to build once first annular shoulder 44 engages with inner cylinder 58 at pump intersection 62. The pressure builds in pump chamber 56 due to the forward movement of piston 42' and the sealing interface between outer surface 90 and inner cylinder 58. Outlet check valve 34 remains closed until the pressure in pump chamber 56 reaches a threshold pressure required to cause outlet check valve 34 to open. For example, spring 100 can be sized to control the pressure output by pump 32. Outlet check valve 34 shifts open and the sanitary fluid flows downstream through outlet check valve 34 and spray valve 52 and out through nozzle 24.

Piston 42' continues through the pressure stroke until reaching the position shown in FIG. 2A, showing the position associated with the end of the pressure stroke. Pump chamber 56 is at a minimum volume with piston 42' at the end of the pressure stroke. Drive 30 causes piston 42' to reverse direction and shift rearward through pump bore 66 and through the suction stroke.

Piston 42' begins to shift in axial direction AD2. Valve member 98 shifts and reengages seat 102 such that outlet check valve 34 is in a closed state. A negative pressure condition forms in the expanding pump chamber 56. Piston head 80 passes over pump intersection 62, opening a flowpath between fluid intake 54 and pump chamber 56. The negative pressure within pump chamber 56 draws sanitary spray fluid into pump chamber 56.

During the suction stroke, second annular shoulder 92 prevents piston 42' from causing gouging and/or causing other interference damage to the portion of polymer pump body 40 forming inner cylinder 58. Second annular shoulder 92 is the first portion of piston head 80 to contact the portion of polymer pump body 40 forming upstream cylinder 68. Second annular shoulder 92 engages that portion of pump body 40 to seal a flowpath between fluid intake 54 and rear chamber 72.

As piston 42' shifts through the suction stroke, groove 84 and piston neck 82 enter into and axially overlap with upstream cylinder 68. Groove 84 can pull spray fluid through inner cylinder 58 in advance of piston head 80 as piston 42' proceeds through the suction stroke, further enhancing cooling. The sanitary fluid can also lubricate inner cylinder 58 to reduces friction during the suction stroke.

The axial length of groove 84 can be longer than the axial length of upstream cylinder 68. For at least a portion of the pump cycle, groove 84 axially overlaps with a full length of upstream cylinder 68. In such a position, groove 84 provides a fluid flowpath between fluid intake 54 and rear chamber 72. The flowpath allows fluid to flow rearward between piston 42' and upstream cylinder 68 to rear chamber 72. Throat seal 60 prevents rearward flow out of pump body 40. A return flow of the spray fluid can flow through return bore 70 and back to reservoir 18. Groove 84 providing flow through upstream cylinder 68 provides cooling to the portion of pump body 40 forming upstream cylinder 68. The cooling counteracts frictional heat generated during reciprocation of piston 42'. The sanitary fluid can also lubricate the interface between piston 42' and pump body 40.

Piston 42' moves in second axial direction AD2 until piston 42' reaches the end of the suction stroke, shown in FIG. 2B. Piston 42' has thus completed one pump cycle. Drive 30 causes piston 42' to reverse direction and proceed back through the pressure stroke. Piston 42' is thereby driven in a reciprocating manner to pump spray fluid from reservoir 18 out through nozzle 24. The interference fit between piston 42' and pump body 40 facilitates pumping by pump 32 and the spraying of sanitary fluids.

Pump 32 provides significant advantages. Piston 42' is sufficiently rigid to generate spray pressures and is also formed of corrosion-resistant material. Pump body 40 is formed from polymer, which can be a single block. The polymer pump body 40 forms inner cylinder 58 that directly interfaces with piston 42' during reciprocation to support formation of the spray pressures. The direct interface reduces the part count of sprayer 10 relative other handheld sprayers that can include internal cylinders formed from materials susceptible to corrosion. The direct interface is resistant to the corrosive properties of sanitary fluids and capable of generating the desired spray pressures (e.g., up to about 10.34 MPa (1500 psi)). Sprayer 10 is thereby able to generate sprays of sanitary fluids and sprayer 10 facilitates simplified, time-efficient, and cost-efficient manufacturing and operation.

First annular shoulder 44 provides a smooth transition that prevents gouging and other wear damage to pump body 40 as piston 42' passes over pump intersection 62 and into inner cylinder 58 and through inner cylinder 58. First annular shoulder 44 thereby facilitates direct contact between a moving pumping member and a stationary pump body. First annular shoulder 44 seals pump chamber 56 and allows piston 42' to pass over pump intersection 62 with a smooth transition while eliminating sharp corners and thereby preventing direct contact with pump body 40 and a sharp corner. First annular shoulder 44 thereby improves operability, reduces operating costs, and prevents undesired wear and damage.

Pump 32 provides efficient cooling and operation. Piston head 80 has a reduced surface area interfacing with inner cylinder 58 to form an annular seal during reciprocation. The reduced surface area reduces the formation of undesired frictional heat. Groove 84 carries sanitary fluid into inner cylinder 58 behind piston head 80 to act as coolant within pump 32. Groove 84 pulls the sanitary fluid ahead of piston head 80 during the suction stroke, further cooling pump 32. Groove 84 opens a flowpath through upstream cylinder 68 to allow for cooling fluid flow through upstream cylinder 68. Groove 84 thereby facilitates coolant flow to reduce heat accumulation within pump 32 and extend the operating life of pump 32.

The interface between piston head 80 and inner cylinder 58 also allows pump 32 to run dry for a period of time before failing. In some examples, pump 32 can run dry for up to five minutes. The interface thereby facilitates use and efficient operation of sanitary sprayer 10 by users of varying skills and qualification levels. For example, an inexperienced user may activate pump 32 before sanitary fluid is connected to fluid intake 54. The dry-run time provided at a metal-polymer interface by pump 32 prevents that user from inadvertently rendering pump 32 inoperable.

Figure 3A:
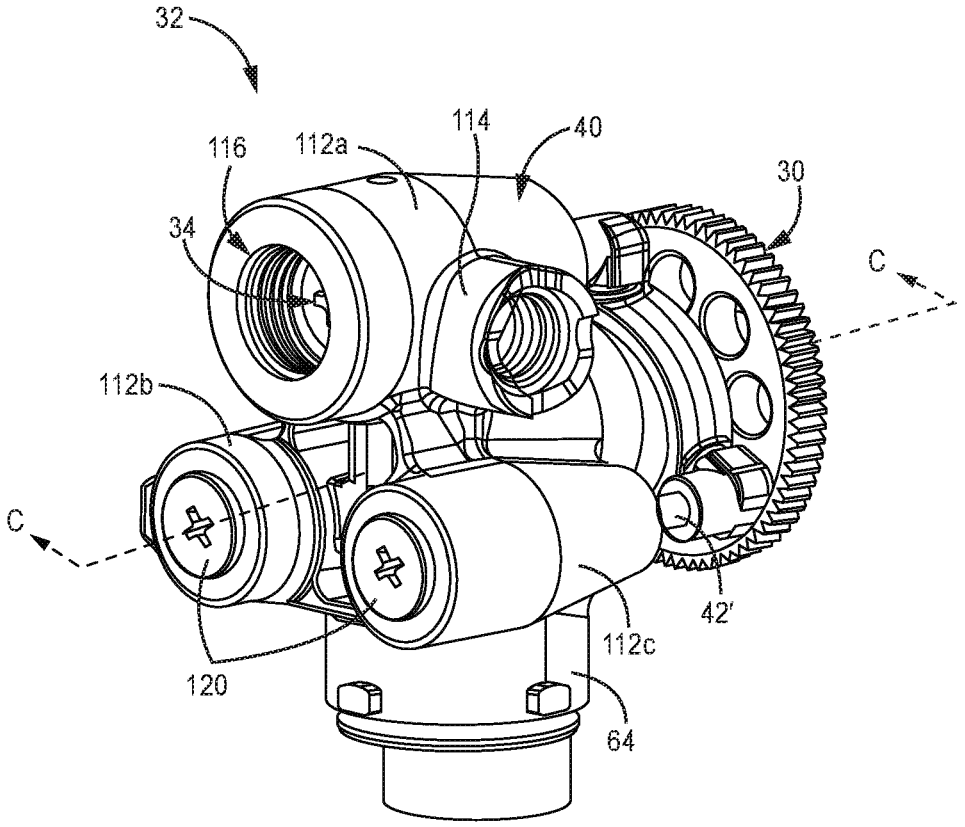
FIG. 3A is a front isometric view of a pump.
Figure 3B:
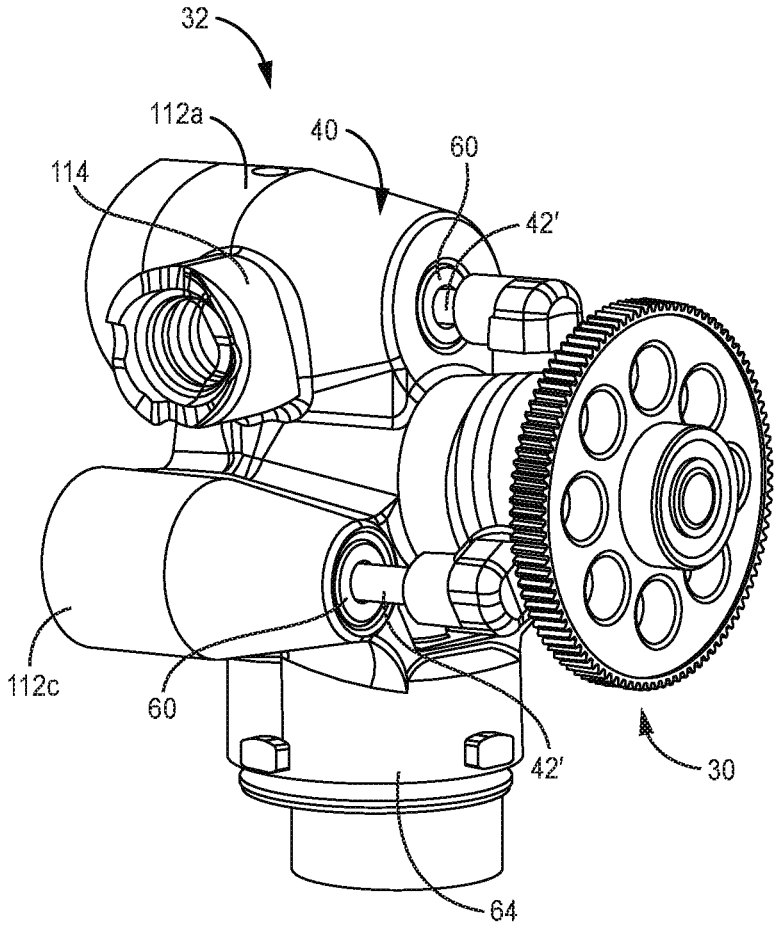
FIG. 3B is a rear isometric view of the pump.
Figure 3C:
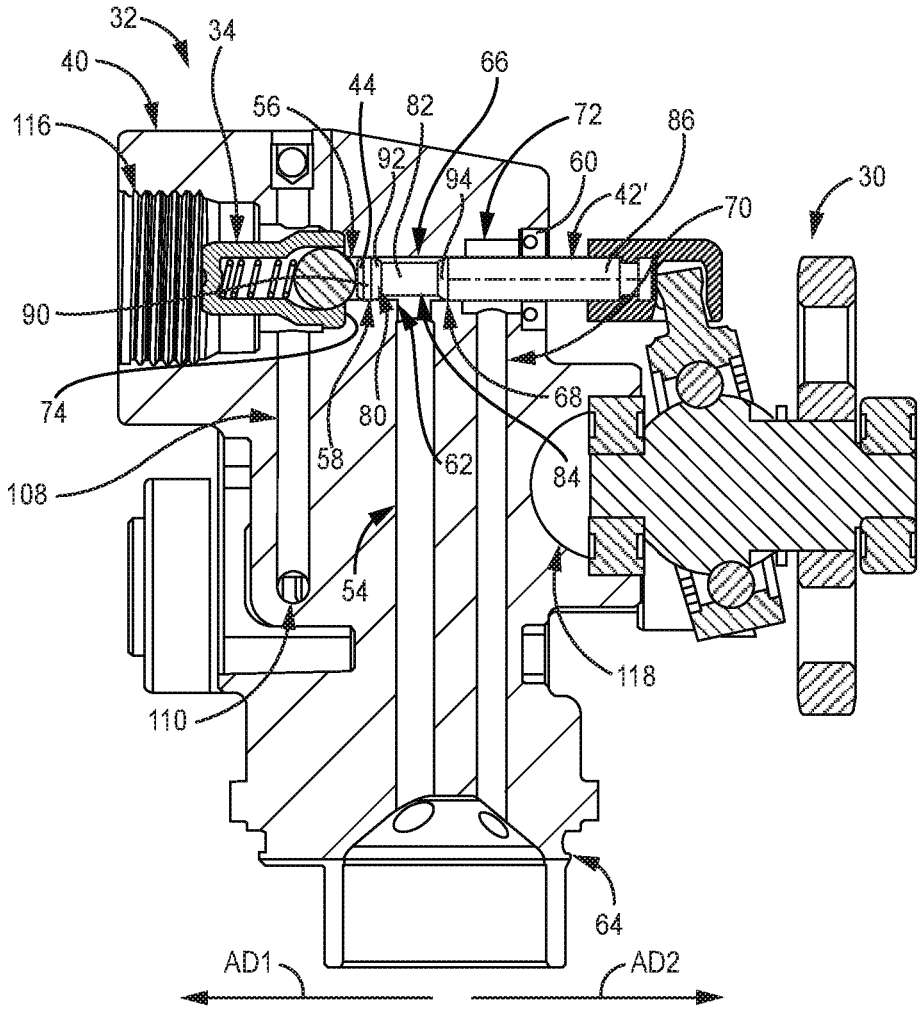
FIG. 3C is a cross-sectional view taken along line 3-3 in FIG. 3A.
Figure 3D:
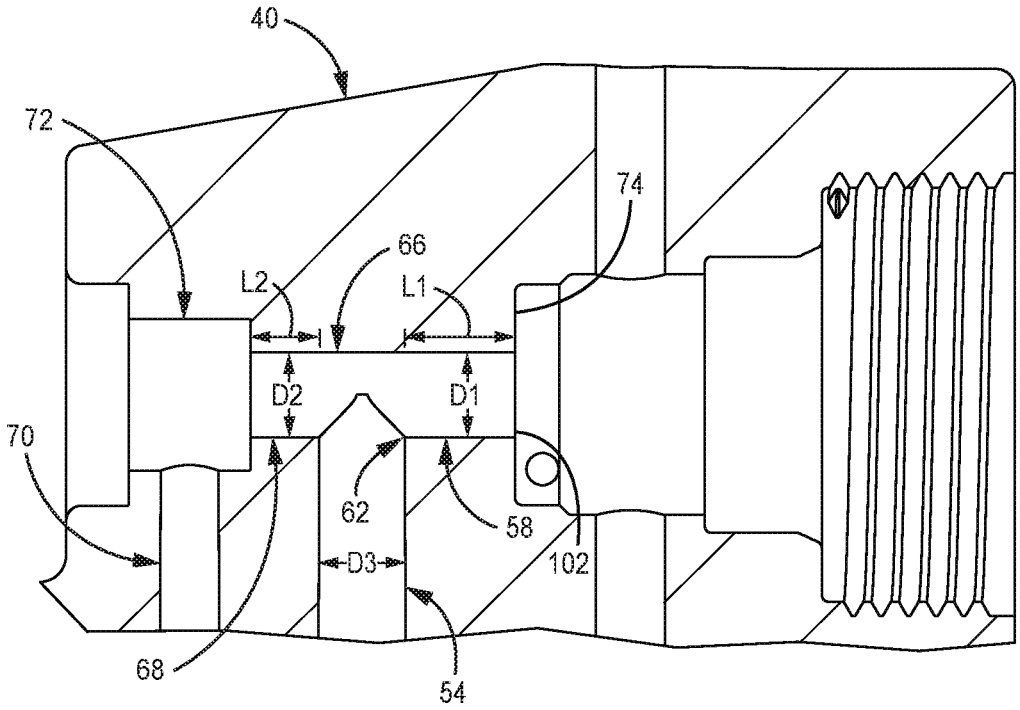
FIG. 3D is an enlarged cross-sectional view of a portion of a pump body of the pump shown in FIGS. 3A-3C.

FIG. 3A is a first isometric view of pump 32 and drive 30. FIG. 3B is a second isometric view of pump 32 and drive 30. FIG. 3C is a cross-sectional view taken along line 3-3 in FIG. 3A. FIG. 3D is an enlarged cross-sectional view of a portion of pump body 40. FIGS. 3A-3D will be discussed together. Pump 32 and drive 30 can be considered to form a pump assembly, which can be used in a sprayer, such as sprayer 10 (best seen in FIGS. 1A and 1B). Pump 32 includes pistons 42' and pump body 40. Fluid intake 54, inner cylinder 58, pump intersection 62, pump bore 66, upstream cylinder 68, return bore 70, rear chamber 72, stop 74, radial bores 108 (only one of which is shown), and flow intersection 110 of pump body 40 are shown. Pump body 40 further includes pump neck 64, cylinder housings 112*a*-112*c*, prime valve mount 114, tip interface 116, and support aperture 118.

Pump body 40 can be formed as a solid block of polymer, such as nylon or acetal homopolymer. Pump body 40 can be injection molded. One or more of the passageways and openings in pump body 40 can be formed by the injection molding process. One or more of the passageways and openings in pump body 40 can be machined from the polymer block forming pump body 40 after molding.

Cylinder housings 112*a*-112*c* are formed by pump body 40 and surround the piston bores 66 that pistons 42' reciprocate within. Pump neck 64 extends from a lower end of pump body 40. In the example shown, pump neck 64 includes projections configured to interface with slots to support a reservoir on pump body 40. Prime valve mount 114 is formed by pump body 40 and is configured to provide a location for prime valve 22 (FIG. 1A) to be mounted to sprayer 10. Prime valve 22 can be fully supported by pump body 40. In some examples, a portion of pump body 40 extends out of the front end of sprayer housing 12. (best seen in FIG. 1B). For example, a cylinder housing 112, such as cylinder housings 112*b*, 112*c*, can be exposed outside of housing 12.

Support aperture 118 is formed in a back end of pump body 40. Drive 30 can be mounted to pump body 40 at support aperture 118 such that drive 30 is at least partially supported by pump body 40. For example, a bearing can be mounted within support aperture 118 and drive 30 can be supported by the bearing 122.

Pistons 42' extend from drive 30 into cylinder housings 112*a*-112*c*. In the example shown, pump 32 includes three pistons 42'. It is understood that some examples of pump 32 can include other numbers of pistons 42', such as one piston 42'. The axes of reciprocation of each of the multiple pistons 42' can be disposed parallel one another. The axis of reciprocation of the piston 42' in cylinder housing 112*b* can be offset from and parallel with the axis of reciprocation of the piston 42' in cylinder housing 112*a*. The axis of reciprocation of the piston 42' in cylinder housing 112*c* can be offset from and parallel with the axes of reciprocation of the pistons 42' in cylinder housings 112*a*, 112*b*. The axis of reciprocation of piston 42' in cylinder housing 112*a* can be coaxial with spray axis S-S.

Pump bore 66 is formed axially through pump body 40. The pump bore 66 shown is formed in cylinder housing 112*a*. Similar or identical pump bores 66 can be formed in each of cylinder housings 112*b*, 112*c*. Tip interface 116 is formed in pump body 40 downstream of piston 42'. Tip interface 116 is configured to receive a portion of tip assembly 20 such that pump body 40 supports tip assembly 20. In the example shown, tip interface 116 includes internal threading configured to interface with external threading on the tube 50 (best seen in FIG. 1B). It is understood, however, that tip interface 116 can be of any configuration suitable for supporting tip assembly 20. Plugs 120 are disposed in openings similar to tip interface 116 but that are formed at the downstream end of each of cylinder housings 112*b*, 112*c*.

Fluid intake 54 extends from pump neck 64 to pump bore 66. Fluid intake 54 intersects pump bore 66 at pump intersection 62. Inner cylinder 58 is disposed on a downstream side of pump intersection 62. Pump chamber 56 is defined within pump bore 66 between piston face 88 of piston 42' and outlet check valve 34 and by inner cylinder 58. Upstream cylinder 68 is disposed on an upstream side of pump intersection 62. Rear chamber 72 is disposed on a downstream side of upstream cylinder 68. Return bore 70 extends between rear chamber 72 and pump neck 64. Return bore 70 provides a pathway for spray fluid to recirculate back to reservoir 18 from pump bore 66.

Throat seal 60 is disposed at an opposite end of pump bore 66 from outlet check valve 34 and pump chamber 56. Piston 42' extends through and interfaces with throat seal 60. Piston body 86 interfaces with throat seal 60. Throat seal 60 forms a dynamic seal with piston 42' during reciprocation of piston 42'.

Piston 42' can dynamically seal at multiple locations along pump bore 66 during operation. In some examples, throat seal 60 is the only dynamic seal interfacing with piston 42' that is not formed by the pump body 40. Piston 42' seals with throat seal 60 throughout the full pump cycle. In some examples, piston 42' interfaces with the portion of pump body 40 forming upstream cylinder 68 throughout the full pump cycle. In the example shown, piston 42' can disengage with that portion of the pump body 40 during at least a portion of the pump cycle. Piston 42' dynamically seals with the portion of pump body 40 forming inner cylinder 58 to pressurize and pump the spray fluid. Piston 42' at least partially disengages from pump body 40 to open a flowpath and allow spray fluid to enter pump chamber 56. In some examples, the dynamic seal between piston 42' and throat seal 60 is the only dynamic seal formed with piston 42' that is fully annularly engaged during a portion of the pump cycle.

Outlet check valve 34 is disposed within cylinder housing 112*a*. Similar outlet check valves 34 are disposed within each of cylinder housings 112*b*, 112*c* to facilitate pumping by the pistons 42' associated with those cylinder housings 112*b*, 112*c*. Outlet check valve 34 can be supported by but not fixed to pump body 40. In the example shown, pump body 40 prevents cage 96 from shifting in the second axial direction AD2 by an interface with pump between cage 96 and stop 74, which is formed by a portion of pump body 40.

Stop 74 extends radially outward from seat 102 formed at the intersection of stop 74 and inner cylinder 58.

As best seen in FIGS. 2A and 2B, the tip assembly 20 can interface with cage 96 to prevent cage 96 from shifting axially forward. The plugs 120 can similarly retain the outlet check valves 34 in cylinder housings 112*b*, 112*c*. Removing tip assembly 20 or plugs 120 allows portions of the respective outlet check valves 34, such as cage 96 and other components of outlet check valve 34, to be removed from pump body 40 without further disconnecting from pump body 40, except due to fluid residue in some cases. As such, some examples of outlet check valve 34 are not actively fastened to pump body 40.

Radial bores 108 extend through pump housing 12 from each pump bore 66. Radial bores 108 intersect the pump bores 66 at locations downstream of the respective outlet check valves 34. Radial bores 108 intersect at flow intersection 110. The radial bores 108 associated with cylinder housings 112*b*, 112*c* provide fluid to flow intersection 110. The fluid flows through the radial bore 108 associated with cylinder housing 112*a*. The spray fluid flows to pump bore 66 in cylinder housing 112*a* and downstream to tip assembly 20 and out through nozzle 24 as the fluid spray. While radial bores 108 extend generally perpendicular to spray axis S-S in the example shown, it is understood that radial bores 108 can be of any desired orientation configured to provide uninterrupted fluid flow to tip assembly 20.

As discussed above with regard to FIGS. 2A and 2B, first annular shoulder 44 facilitates piston 42' passing over pump intersection 62 to form a full annular seal with inner cylinder 58 as piston 42' proceeds through the pressure stroke. Second annular shoulder 92 and third annular shoulder 94 similarly facilitate smooth transitions into and out of full annular sealing interfaces with pump body 40.

The cylindrical exterior of the piston 42' directly contacts the cylindrical interior of the inner cylinder 58 and the surfaces slide relative to each other during the pressure and suction strokes. The sliding interface forms a seal to prevent sanitary fluid from leaking out of pump chamber 56 past the piston 42'. To increase the interference and to prevent leaking out the back of the pump body 40 along the piston 42', the outer diameter of the piston 42' can, in some examples, be greater than the inner diameter of the inner cylinder 58 (when the piston 42' is not directly within the pump chamber 56).

Inner cylinder 58 has a diameter D1. Upstream cylinder 68 has a diameter D2. Fluid intake 54 has a diameter D3. Piston head 80 has diameter D4 (FIG. 4A) at outer surface 90. In some examples, a ratio of the diameter D1 of inner cylinder to diameter D4 of outer surface 90 can be greater than about 1.05:1. In some examples, the ratio between diameter D1 and diameter D4 can be between about 1.1:1 and 1.2:1. In some examples, the ratio between diameter D1 and diameter D4 can be about 1.1:1. The relative sizes of diameters D1 and D4 facilitates the tight fit between piston 42' and piston body 86 to form a dynamic sliding seal to pressurize and pump the fluid.

Inner cylinder 58 has length L1. Upstream cylinder has length L2. Groove 84 has a length GL. Piston neck 82 has a diameter D5. The length GL of groove 84 can be larger than length L1 of inner cylinder 58. The relative lengths L1 and GL facilitate actively cooling inner cylinder 58 by pulling the spray fluid into inner cylinder 58. Groove length GL can be larger than diameter D3 of fluid intake 54. A ratio of a diameter D3 to length GL can be between about 1.8:1 to 2:1. Groove 84 also maintains fluid communication with fluid intake 54 and is not fully sealed within inner cylinder 58 during reciprocation, enhancing cooling.

The length GL of groove can be larger than length L2 of upstream cylinder 68. A ratio of the diameter D5 of piston neck 82 to the diameter D2 of upstream cylinder 68 can be about 1.1:1 to 1.2:1. In some examples, the ratio of diameter D5 to diameter D2 can be between about 1.12:1 and 1.18:1. The larger length of groove 84 relative upstream cylinder 68 forms the cooling flowpath through upstream cylinder 68 during reciprocation. The relative diameters between piston neck 82 and upstream cylinder 68 provide a restrictive flowpath between fluid intake 54 and rear chamber 72 that limits pressure drop. The relative sizes of piston 42' and upstream cylinder 68 facilitate cooling with the spray fluid and prevent undesired pressure drop and maintain pump 32 in the primed state.

The polymer material defining the inner cylinder 58 can elastically expand due to the movement of the piston 42' within the pump bore 66, specifically along the inner cylinder 58. For example, forward movement of the piston 42' through the inner cylinder 58 causes the inner diameter of the inner cylinder 58 along the pump chamber 56 to expand from contact with the piston 42' during the pressure stroke. First annular shoulder 44 facilitates piston 42' passing into inner cylinder 58 over the pump intersection 62. The inner cylinder 58 then relaxes and shrinks slightly as the piston 42' withdraws from that portion of the inner cylinder 58 during the suction stroke. In the example shown, the inner cylinder 58 can relax and shrink slightly after outer surface passes over that portion of inner cylinder 58. For example, inner cylinder 58 can have two relaxed diameter portions separated by an expanded diameter portion in contact with piston 42'. The two relaxed diameter portions are axially separated by the expanded diameter portion. Inner cylinder 58 is forced to expand and contract due to direct contact and then disengagement from the piston 42'. Such elastic interaction forms a flexible but tight dynamic seal between piston 42' and pump body 40.

Pump 32 provides significant advantages. Pump body 40 can be formed as a single block of polymer, simplifying manufacturing and reducing costs. Various flowpaths are formed directly by pump body 40. Pump body 40 directly defines at least a portion of pump chambers 56 of pump 32. Pump body 40 directly defining the flowpaths and pressure chambers of pump 32 facilitates efficient, speedy manufacturing while providing a simplified process. The various pathways can be formed simultaneously with pump body 40 during an injection molding process and/or machined into pump body 40 after the molding process. The direct formation means that separate components do not need to be aligned and assembled together to define various chambers, such as pump chamber 56. Instead, piston 42' directly interfaces with pump body 40 to pump and pressurize the sanitary spray fluid. Piston 42' moves relative to and interfaces with pump body 40 and throat seal 60. Minimizing the count of dynamically interfacing parts prevents misalignment, reduces wear, and also simplifies operation of the pump. While the embodiments herein have been discussed in connection spraying a sanitary fluid, any sprayer and/or pump referenced herein can spray and/or pump any desired fluid, not just sanitary fluid.

Figure 4A:
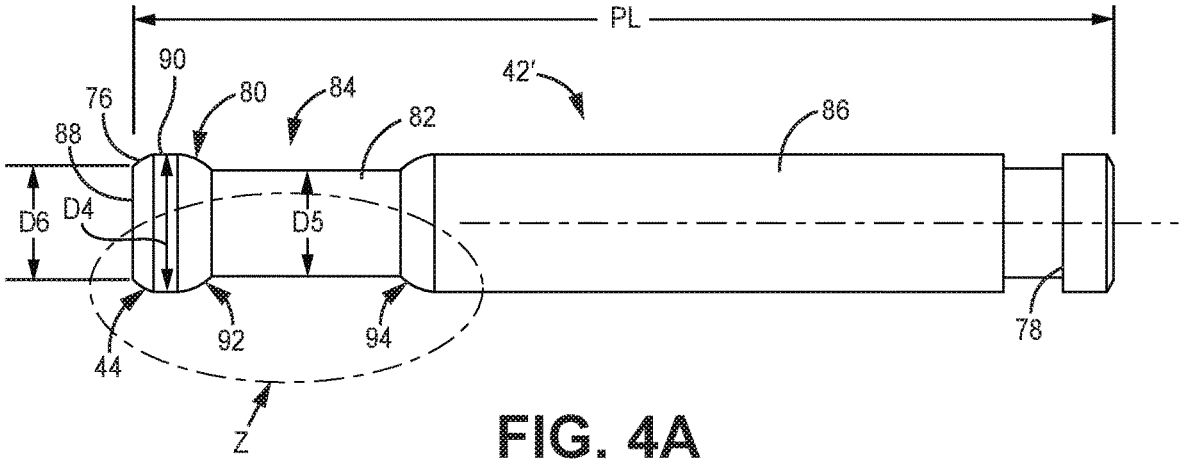
FIG. 4A is a side elevational view of a piston.
Figure 4B:
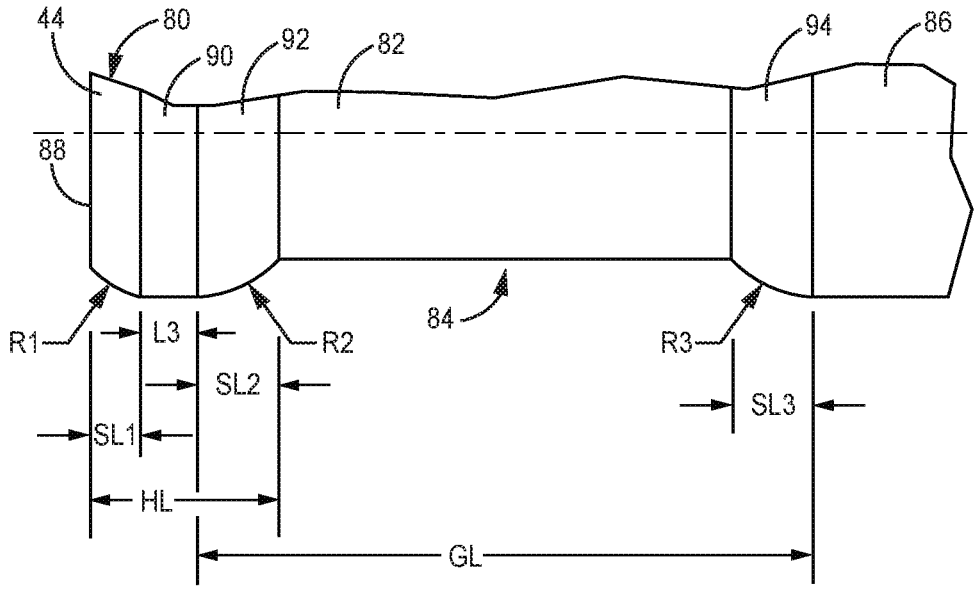
FIG. 4B is an enlarged view of detail Z shown in FIG. 4A.

FIG. 4A is a side elevational view of piston 42'. FIG. 4B is an enlarged view of detail Z in FIG. 4A. FIGS. 4A and 4B will be discussed together. Piston 42' includes first annular shoulder 44, first end 76, second end 78, piston head 80, piston neck 82, groove 84, piston body 86, second annular shoulder 92, and third annular shoulder 94. Piston head 80 includes piston face 88 and outer surface 90.

Piston 42' is configured to reciprocate within a bore to pump sanitary spray fluid. Piston 42' is configured to reciprocate within a bore to pressurize sanitary fluid and drive the sanitary fluid to a nozzle, such as nozzle 24 (best seen in FIG. 1B), to generate a sanitary fluid spray. Piston 42' can be formed from a metal or other material sufficiently rigid to generate the spray pressures. For example, piston 42' can be formed of stainless steel, among other options.

Piston has a length PL between first end 76 and second end 78. Piston head 80 is disposed at first end 76 of piston 42'. Piston head 80 has a length HL. A ratio between head length HL and piston length PL can be about 10:1. In some examples, the ratio between head length HL and piston length PL can be between about 12:1 to 13:1. In one example, the ratio between head length HL and piston length PL can be about 12:4:1 to 12.5:1. Piston face 88 forms the distal end of piston 42'. Piston face 88 forms a majority of the portion of piston 42' contacting the spray fluid within pump chamber 56. Outer surface 90 extends annularly around piston head 80. Outer surface 90 forms a contact surface of piston 42'. Piston head 80 has a diameter D4 at outer surface 90 and a diameter D6 at piston face 88. In some examples, diameter D4 forms a largest diameter portion of piston 42'. Outer surface 90 has a length L3. In some examples, a ratio between length PL and length L3 can be about 40:1.

In some examples, a ratio of diameter D6 to diameter D4 is about 1.2:1. In some examples, piston face 88 forms between about 75-percent to 90-percent of the portion of piston 42' exposed to the fluid within pump chamber 56. In some examples, piston face 88 forms about 80-percent to 85-percent of the portion of piston 42' exposed to the fluid within pump chamber 56. The remaining portion of the piston 42' exposed to the fluid within pump chamber 56 can be formed by first annular shoulder 44.

Piston neck 82 extends from a downstream side of piston head 80. Groove 84 is defined about piston 42'. Groove 84 extends around piston neck 82. Groove 84 can carry spray fluid within piston 42' during reciprocation to provide the spray fluid to cool surfaces within pump 32. Groove 84 can also provide a flowpath for spray fluid to circulate back to reservoir 18. Groove 84 has a length GL between the downstream end of second annular shoulder 92 and the upstream end of third annular shoulder 94. The length GL of groove 84 is larger than the length L3 of outer surface 90. A ratio between length GL and length L3 can be greater than about 10:1. In some examples, the ratio between length L3 and length GL can be about 10.7:1. As such, the length GL of groove 84 larger than the length of the portions of piston 42' contacting inner cylinder 58 during any portion of the pump cycle. The larger length GL relative length L3 facilitates cooling and reduced friction within inner cylinder 58.

The length GL of groove 84 can be larger than diameter D4 of piston head 80, such that the length GL can be larger than the largest diameter of piston 42'. The length GL of groove 84 can be larger than the largest diameter of piston 42'. A ratio between diameter D4 and length GL can be between about 1.8:1 to about 2:1. In some examples, the ratio between diameter D4 and length GL can be about 1.87:1. A ratio between length GL of groove 84 and length PL of piston 42' can be about 3.8:1.

Groove 84 has a depth GD between the exterior surface of piston neck 82 and the exterior surface of piston head 80. A ratio between depth GD and length GL can be between about 8:1-8.2:1. The depth to length ratio provides a desired volume of cooling fluid into inner cylinder 58 and upstream cylinder 68 while maintaining desired pressure and the prime of pump 32.

First annular shoulder 44 extends between and connects outer surface 90 and piston face 88. First annular shoulder 44 is contoured such that the diameter of piston 42' reduces from outer surface 90 to piston face 88. First annular shoulder 44 provides a smooth transition between piston face 88 and outer surface 90. First annular shoulder has a length SL1. In some examples, first annular shoulder 44 is curved. First annular shoulder 44 can be a convex annular surface. In the example shown, first annular shoulder 44 has radius R1. In some examples, radius R1 can be about twice shoulder length SL1.

Second annular shoulder 92 extends between and connects outer surface 90 and piston neck 82. Second annular shoulder 92 is contoured such that the diameter of piston reduces from outer surface 90 to piston neck 82. Second annular shoulder 92 provides a smooth transition between outer surface 90 and piston neck 82. Second annular shoulder 92 has a length SL2. In some examples, second annular shoulder 92 is curved. Second annular shoulder 92 can be a convex annular surface. In the example shown, second annular shoulder 92 has radius R2.

Third annular shoulder 94 extends between piston neck 82 and piston body 86. Third annular shoulder 94 is contoured such that the diameter of piston reduces from piston body 86 to piston neck 82. Third annular shoulder 94 has a length SL2. In some examples, second annular shoulder 92 is curved. Second annular shoulder 92 can be a convex annular surface. In the example shown, second annular shoulder 92 has radius R2.

In some examples, lengths SL2 and SL3 can be the same. In some examples, radius R2 can be the same as radius R1. In some examples, a ratio between length SL1 and length SL2 can be about 1.5:1 to about 1.8:1. In some examples, the ratio between length SL1 and length SL2 cab be about 1.64:1. In some examples, a ratio between radius R1 and radius R2 can be about 1.1:1 to about 1.3:1. In some examples, the ratio between radius R1 and radius R2 can be about 1.2:1.

Piston 42' facilitates direct interfacing between piston 42' and a polymer pump body, such as pump body 40. During operation, the radiused first annular shoulder 44 is a first portion of piston 42' to contact the portion of pump body 40 defining inner cylinder 58. Piston 42' is shaped to form a fluid seal with pump body 40 to facilitate pumping while also smoothly passing into and out of annular sealing engagement with pump body 40. First annular shoulder 44 can push against pump body 40 to flex the material forming inner cylinder 58 as pump moves through the pressure stroke. Similar to first annular shoulder 44, second annular shoulder 92 prevents contact damage between piston 42' and pump body 40. Second annular shoulder 92 can prevent contact damage to inner cylinder 58 as piston 42' moves within inner cylinder 58 and passes out of inner cylinder 58. In some examples, second annular shoulder 92 is configured to annularly contact the portion of pump body 40 forming upstream cylinder 68 to seal the path through upstream cylinder 68. Second annular shoulder 92 also smoothly interfaces with upstream cylinder 68 to prevent contact damage. Similar to first annular shoulder 44 and second annular shoulder 92, third annular shoulder 94 prevents contact damage between piston 42' and pump body 40. Third annular shoulder 94 annularly contacts a portion of pump body 40 forming upstream cylinder 68 to seal a path through upstream cylinder 68. Third annular shoulder 94 can push against pump body 40 to flex the material forming upstream cylinder 68 as pump moves through the pressure stroke.

Piston 42' provides significant advantages. Piston head 80 directly contacts pump body 40 to build pressure and pump fluid. First annular shoulder 44 provides a smooth transition between piston face 88 and outer surface 90. First annular shoulder 44 eliminates sharp corners at the leading edge of piston 42'. First annular shoulder 44 thereby facilitates an interference fit between piston 42' and portions of pump body 40 by allowing piston 42' to pass through portions of pump body 40 that are narrower than the diameter of the contact surface of piston 42' (e.g., narrower than diameter D4 of outer surface 90). The tight fit facilitated by first annular shoulder 44 allows for direct interfacing between a metallic piston 42' and polymer pump body 40, thereby allowing for pumping of corrosive fluids, such as sanitary fluid. Second annular shoulder 92 and third annular shoulder 94 similarly prevent contact damage. Second annular shoulder 92 can prevent contact damage to inner cylinder 58 as piston 42' moves within inner cylinder 58 and passes out of inner cylinder. Third annular shoulder 94 annularly contacts a portion of pump body 40 forming upstream cylinder 68 to seal a path through upstream cylinder 68. Third annular shoulder 94 can push against pump body 40 to flex the material forming upstream cylinder 68 as pump moves through the pressure stroke.

Outer surface 90 provides a small sliding contact area between piston 42' and inner cylinder 58. The size of outer surface 90 minimizes the contact area between piston 42' and inner cylinder 58 to prevent frictional heat from building in pump 32. Groove 84 also carries spray fluid within inner cylinder 58 such that the spray fluid can act as a coolant within pump 32 and reduce friction between piston 42' and the polymer pump body 40. Piston 42' thereby prevents undesired contact and heat from damaging pump body 40. Piston 42' increases the operational life of pump 32.

Piston 42' is shaped such that a contoured portion of piston 42' first encounters diameter changes formed within pump bore 66. For example, first annular shoulder 44 encounters and generates an annular effective seal with inner cylinder 58 at pump intersection 62. The contouring on piston 42' facilitates smooth transitions between a partial or no annular interface and a full annular interface between piston 42' and pump body 40. The smooth transitions prevent piston 42' from causing gouging and other wear damage to pump body 40, facilitates pumping, increases the operational life of pump 32, minimizes the number of interfacing elements, and removes hard materials that can be used to define a pumping chamber but are susceptible to corrosion by sanitary fluids.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump for a handheld fluid sprayer, the pump comprising:

a polymer pump body formed from a polymer material that defines an inner surface of an inner cylinder that forms a pumping chamber within the polymer pump body;

a driver, the driver comprising an electric motor;

a first metallic piston including an outer surface, a piston face, and a tapered interface between the outer surface and the face, wherein the first metallic piston is configured to reciprocate within the inner cylinder such that the outer surface of the piston comes into and out of contact with a portion of the inner surface defining the pumping chamber to pump spray fluid, the piston reciprocated by the driver; and a nozzle to spray the spray fluid pumped by reciprocation of the piston within the pumping chamber, wherein an outer diameter of the first metallic piston at the outer surface is larger than an inner diameter of the pumping chamber at the portion of the inner surface defining the pumping chamber when the outer surface is out of annular contact with the portion of the inner surface defining the pumping chamber.

2. The pump of claim 1, wherein the tapered interface comprises:

a first annular shoulder extending between the outer surface and the piston face such that the outer diameter of the first metallic piston is larger than a diameter of the first metallic piston at the piston face.

3. The pump of claim 2, wherein the first annular shoulder is curved between the outer surface and the piston face.

4. The pump of claim 3, wherein the metallic piston further comprises:

a piston head disposed at a distal end of the piston, wherein the first annular shoulder, the piston face, and the outer surface are formed on the piston head;

a piston neck extending from the piston head;

a groove disposed around the piston neck;

a second annular shoulder curved between the outer surface and the piston neck; and a third annular shoulder curved between the neck and a piston body extending from an opposite side of the piston neck from the piston head;

wherein the groove has a first length and the outer surface has a second length; and wherein the first length is greater than the second length.

5. The pump of claim 4, wherein:

the polymer pump body further comprises:

a leak path formed in the polymer pump body between a leak chamber and a neck formed by the pump body;

an upstream cylinder disposed coaxially with the inner cylinder and disposed axially between the inner cylinder and the leak chamber;

wherein the upstream cylinder has a third length; and wherein the first length is greater than the third length.

6. The pump of claim 5, wherein the groove is sized such that the groove does not axially overlap with the upstream cylinder with the first metallic piston at the end of a pressure stroke.

7. The pump of claim 1, wherein the inner diameter of the inner cylinder at the inner surface is configured to expand when the outer surface of the piston comes into contact with the inner surface of the inner cylinder during reciprocation of the piston.

8. A handheld sanitary fluid sprayer comprising:

a sprayer housing;

a handle extending from the sprayer housing; and the pump of claim 1 at least partially disposed within the sprayer housing, is supported by the sprayer housing, and is configured to be operated by the electric motor.

9. A handheld sanitary fluid sprayer comprising:

a housing;

a handle configured to support the housing;

a reservoir connected to the housing and configured to hold sanitary fluid;

a nozzle configured to emit a spray of sanitary fluid;

a trigger configured to control spraying from the nozzle;

a driver, the driver comprising an electric motor; and a pump supported by the housing and configured to pump sanitary fluid from the reservoir to the nozzle, the pump comprising:

a polymer pump body defining an inlet bore and a first inner cylinder, the inlet bore configured to provide the sanitary fluid to the first inner cylinder; and a first metallic piston configured to linearly reciprocate within the first inner cylinder to pump the sanitary fluid to the nozzle under pressure;

wherein the first metallic piston is configured to be reciprocated by the driver within the first inner cylinder so that a metal-to-polymer annular interface between a cylindrical exterior of the first metallic piston and a cylindrical interior of the first inner cylinder dynamically seals to prevent sanitary fluid from leaking out backward past the metal-to-polymer annular interface and out of the inner cylinder during reciprocation to pump sanitary fluid, wherein the cylindrical interior is formed from and defined by the polymer pump body;

wherein the cylindrical exterior of the first metallic piston interfaces with the cylindrical interior of the first inner cylinder during a first portion of a pump stroke of the first metallic piston; and wherein the inner diameter of the cylindrical interior of the first inner cylinder is configured to increase due to an interference fit with the first metallic piston at the metal-to-polymer annular interface as the first metallic piston moves in a first stroke direction and to decrease due to loss of the interference fit with the first metallic piston as the first metallic piston moves in a second stroke direction opposite the first stroke direction.

10. The handheld sanitary fluid sprayer of claim 9, wherein the driver further comprises a drive configured to receive a rotational output from the electric motor and output linear reciprocating motion to the first metallic piston.

11. The handheld sanitary fluid sprayer of claim 9, wherein the polymer pump body includes a mounting portion disposed at least partially outside of the housing and configured to interface with the reservoir to mount the reservoir to the handheld sanitary sprayer, and wherein the reservoir is removably mountable to the mounting portion.

12. The handheld sanitary fluid sprayer of claim 9, further comprising:

an outlet check valve disposed within the pump body at a downstream end of the inner cylinder, wherein the outlet check valve includes a valve member configured to seal with the polymer pump body.

13. The handheld sanitary fluid sprayer of claim 9, wherein an outer diameter of the cylindrical exterior of the first metallic piston is larger than the inner diameter of the inner cylinder during a second portion of the pump stroke when the cylindrical exterior is out of annular contact with the cylindrical interior.

14. The handheld sanitary fluid sprayer of claim 9, wherein the first metallic piston is one of a plurality of metallic pistons extending into the pump body to pump the sanitary fluid from the reservoir to the nozzle.

15. The handheld sanitary fluid sprayer of claim 9, wherein an annular shoulder between a piston face of the first metallic piston and an outer surface of the first metallic piston is rounded.

16. A sanitary spray system comprising:

a nozzle configured to emit a spray of sanitary fluid;

a pump configured to pump sanitary fluid to the nozzle under pressure to generate the spray of sanitary fluid, the pump comprising:

a polymer pump body defining a fluid intake and a first inner cylinder, the fluid intake configured to provide the sanitary fluid to the first inner cylinder;

a first metallic piston configured to linearly reciprocate within the first inner cylinder to pump the sanitary fluid to the nozzle under pressure;

wherein a first dynamic seal is formed directly between an outer cylindrical surface of the first metallic piston and an inner cylindrical surface of a portion of the polymer pump body defining the first inner cylinder during reciprocation of the first metallic piston within the first inner cylinder to prevent sanitary fluid from leaking out of the first inner cylinder around the outer cylindrical surface of the first metallic piston to pump the sanitary fluid;

wherein the first metallic piston is configured to come into and out of contact with the portion of the polymer pump body defining the first inner cylinder to pump the sanitary fluid; and wherein an outer diameter of the first metallic piston at the outer cylindrical surface is larger than an inner diameter of the inner cylindrical surface of the portion of the polymer pump body defining the first inner cylinder when the outer cylindrical surface is out of annular contact with the portion of the polymer pump body defining the first inner cylinder.

17. The sanitary spray system of claim 16, wherein the first metallic piston further comprises: an annular shoulder curved between a piston face of the first metallic piston and the outer cylindrical surface of the first metallic piston; wherein the piston is sized such that the annular shoulder forms a first portion of the first metallic piston to contact an intersection between the fluid intake and the first inner cylinder during a pressure stroke of the first metallic piston.

18. The sanitary spray system of claim 17, further comprising:

a throat seal disposed around the piston and forming a second dynamic seal with the piston;

wherein the pump includes a single dynamic interface with the piston that is not formed directly between the piston and the pump body; and wherein the second dynamic seal forms the single dynamic interface.

* * * * *